US006806016B2

(12) United States Patent
Ohno et al.

(10) Patent No.: US 6,806,016 B2
(45) Date of Patent: Oct. 19, 2004

(54) TONER FOR DEVELOPING ELECTROSTATIC IMAGES AND IMAGE FORMING METHOD

(75) Inventors: Manabu Ohno, Shizuoka (JP); Satoshi Yoshida, Tokyo (JP); Satoshi Handa, Tokyo (JP); Akira Hashimoto, Tokyo (JP); Keiji Komoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 94 days.

(21) Appl. No.: 10/352,963

(22) Filed: Jan. 29, 2003

(65) Prior Publication Data

US 2003/0186152 A1 Oct. 2, 2003

Related U.S. Application Data

(62) Division of application No. 09/280,579, filed on Mar. 30, 1999, now Pat. No. 6,528,224.

(30) Foreign Application Priority Data

Apr. 2, 1998 (JP) ..... 10-089122

(51) Int. Cl.[7] ..... G03G 13/08; G03G 13/22

(52) U.S. Cl. ..... 430/124; 430/125; 430/126; 430/109.1; 430/110.1; 430/110.3; 430/110.4

(58) Field of Search ..... 430/108.8, 110.1, 430/108.1, 110.3, 110.4, 109.1, 111.4, 124, 125, 126, 122

(56) References Cited

U.S. PATENT DOCUMENTS

| | | | |
|---|---|---|---|
| 5,176,978 A | 1/1993 | Kumashiro et al. | |
| 5,629,122 A | 5/1997 | Tanikawa et al. | |
| 5,753,396 A | 5/1998 | Nakamura et al. | |
| 5,948,582 A | 9/1999 | Nakamura et al. | |
| 5,998,080 A | 12/1999 | Ohno et al. | |
| 6,077,636 A | 6/2000 | Moriki et al. | |
| 6,177,223 B1 | 1/2001 | Hashimoto et al. | 430/124 |

FOREIGN PATENT DOCUMENTS

| | | |
|---|---|---|
| EP | 0822456 | 2/1998 |
| EP | 869397 A2 | 10/1998 |
| EP | 899617 A1 | 3/1999 |
| JP | 36 10231 | 7/1961 |
| JP | 56 13945 | 4/1981 |
| JP | 59 053856 | 3/1984 |
| JP | 59 061842 | 4/1984 |
| JP | 61 279864 | 12/1986 |
| JP | 63 149669 | 6/1988 |
| JP | 63 235953 | 9/1988 |
| JP | 01 112253 | 4/1989 |
| JP | 01 191156 | 8/1989 |
| JP | 02 123385 | 5/1990 |
| JP | 02 284158 | 11/1990 |
| JP | 03 181952 | 8/1991 |
| JP | 04 162048 | 6/1992 |
| JP | 08 136439 | 5/1996 |
| JP | 09 160283 | 6/1997 |
| JP | 09 197714 | 7/1997 |

OTHER PUBLICATIONS

Database WPI, Section CH, Week 1992 18, Derwent Publ. AN 1992–145193, XP 002125223, for JPO 4–078862.

Database WPI, Section CH, Week 1991 24, Derwent Publ; AN 1991 –173665, XP 002125224, for JPO 3–100661.

Hawl y, GG ed. The Condensed Chemical Dictionary, 9$^{th}$ d. Van Nostrand Reinhold Co., NY (1977), p. 384.

*Primary Examiner*—Janis L. Dote
(74) *Attorney, Agent, or Firm*—Fitzpatrick, Cella, Harper & Scinto

(57) ABSTRACT

A toner suitable for use in electrophotography, etc., is composed of toner particles each containing a binder resin, a colorant and a wax component. The toner has a number-average particle size of 2–6 $\mu$m and a standard deviation in particle size of below 2.6 $\mu$m based on a number-basis distribution of circle-equivalent diameters, an average circularity of 0.970–0.995 and a standard deviation in circularity of below 0.030 based on a circularity frequency distribution, and a residual monomer content of at most 500 ppm. The toner particles have such a microtexture as to provide a particle cross section as observed through a transmission electron microscope (TEM) exhibiting a matrix of the binder resin and a particle of the wax dispersed in a discrete form in the matrix of the binder resin.

34 Claims, 9 Drawing Sheets

TONER FOR DEVELOPING ELECTROSTATIC IMAGES AND IMAGE FORMING METHOD

CROSS REFERENCE TO RELATED APPLICATIONS

This application is a division of application Ser. No. 09/280,579, filed Mar. 30, 1999, now U.S. Pat. No. 6,528, 224.

FIELD OF THE INVENTION AND RELATED ART

The present invention relates to a toner and an image forming method for use in a recording method utilizing electrophotography, electrostatic recording, magnetic recording, etc. More specifically, the present invention relates to a toner and an image forming method for use in a copying machine, a printer and a facsimile apparatus, wherein a toner image formed in advance on an electrostatic image-bearing member is transferred onto a transfer-receiving material.

Hitherto, a large number of electrophotographic processes have been known, wherein generally an electrostatic latent image is formed on a photosensitive member comprising a photoconductive material by various means, then the latent image is developed with a toner, and the resultant toner image is transferred onto a transfer(-receiving) material, such as paper, as desired, and fixed by application of heat and/or pressure to form a fixed toner image as a final image on the transfer material.

In recent years, electrophotographic apparatus inclusive of a copying machine, a printer and a facsimile apparatus, are required to exhibit satisfactory performances for a variety of transfer materials or paper materials, accompanying increasing demands for color images or records. However, respective color toners may have different transferabilities depending on their prescriptions and require different optimum transfer conditions depending on qualities of paper materials. For example, there is a tendency that a thick paper and an OHP (overhead projector) film require a higher value of optimum transfer current, and a thin paper requires a lower transfer current value. Accordingly, if the transfer condition of an apparatus main body is optimized for a thick paper or an OHP film, a so-called "re-transfer" phenomenon that a toner image once transferred onto a transfer material returns to the electrostatic image-bearing member, or a so-called "scattering" phenomenon that the toner is scattered around the resultant toner image, is liable to occur when a thin paper is used. On the other hand, if the transfer condition is optimized for a thin paper, the transfer efficiency or rate of a toner image from the electrostatic image-bearing member to a transfer material is lowered, thus resulting in difficulty with respect to image density or resolution, when a thick paper or an OHP film is used.

Incidentally, as for printer apparatus, those utilizing laser beam or LED become predominant on the market in these days, and copying apparatus based on the digital technique capable of being adapted for multi-functional use are becoming popular, thus requiring a higher resolution than ever. For these reasons, the developing scheme is also required to be adapted for higher resolution. Particularly, in the printer and copying machine based on the digital technique, a smaller thickness of photosensitive layer is becoming frequently adopted so as to provide a high resolution of electrostatic image. In case where a photosensitive member having such a thin photosensitive layer, the electrostatic image is caused to have a lower potential contrast, so that a toner used for developing the electrostatic image is desired to exhibit a higher developing performance.

Particularly, in a monocomponent developing scheme wherein a toner in a form of so-called "ear" or chains is used for development, the resolution in the lateral image direction is liable to be inferior than in the longitudinal direction. Further, compared with a solid image, line images are liable to be developed with a larger amount of attached toner, thus increasing the toner consumption to result in inferior image reproducibility and economical performance. Moreover, in the development with a toner, there are liable to occur difficulties such as a tailing phenomenon that the toner protrudes in its ear form out of the image portion, or toner scattering around the image region, thus providing another factor of lowering the resolution.

As a measure for improving the image reproducibility, it is required to apply an extremely thin layer of toner onto a toner-carrying member (developing sleeve), thus shortening toner ears thereon. However, when a conventional toner is applied to this scheme, a large stress is exerted to both the toner particles and the toner-carrying member surface, thus resulting in difficulties, such as toner surface deterioration, soiling or toner sticking on the toner-carrying member surface, and difficulty in matching with the image forming apparatus.

For alleviating such difficulties, a toner having specified shape factors SF-1 and SF-2 has been proposed in Japanese Laid-Open Patent Application (JP-A 61-279864), but no special care has been taken regarding the transferability of the toner. Further, JP-A 63-235953 has proposed a magnetic toner sphered by application of a mechanical impact, whereby the transferability has been improved to some extent but the improvement is not sufficient, and the developing performance has not reached a level of accomplishing a sufficiently high definition.

On the other hand, in response to the requirements of high resolution and high definition, JP-A 1-112253, JP-A 1-191156, JP-A 2-214156, JP-A 2-284158, JP-A 3-181952 and JP-A 4-162048 have proposed small-particle size toners having a specific particle size distribution. These toners are still companied with difficulties of image quality lowering due to toner deterioration and transferability and also a difficulty that, in a low temperature/low humidity environment, the developing performance is lowered due to excessive toner charge, resulting in a remarkably lower resolution.

JP-A 9-160283 has proposed a toner having an average particle size (diameter) of 6–10 $\mu$m and an average circularity of 0.85–0.98 and containing at most 10 wt. % of particles having a circularity of at most 0.85, whereby improvements in flowability, quick charging performance and cleanability with a cleaning blade are referred to, whereas no care has been taken regarding continuous image forming performance and environmental stability accompanying the decrease in particle size, thus not accomplishing a sufficiently high resolution.

Further, JP-A 9-197714 has proposed a developer for improvement of overall performances by controlling the toner particle shape so as to provide a ratio B/A of 40–80% between a 10%-average diameter B and a 50%-average diameter A of developer particles, an average circularity of 0.93–1.0 and a content at most 3.0% of particles having a circularity of at most 0.85. The developer exhibits some improvement in providing image density stability, but no care has been taken regarding a small particle size having a 50%-average diameter of below 8 μm and an average circularity exceeding 0.96, thus leaving room for improvements in the above-mentioned problems.

On the other hand, in recent years when environmental protection is thought much of, a conventional primary charging and transfer process utilizing corona discharge is being gradually shifted to a primary charging and transfer process using a charging member abutted against an electrostatic image-bearing member.

For example, JP-A 63-149669 and JP-A 2-123385 have proposed such a contact charging system including a contact primary charging step and a contact transfer step, wherein an electroconductive elastic roller is abutted against an electrostatic image-bearing member while being supplied with a voltage to uniformly charge the electrostatic image-bearing member, then the electrostatic image-bearing member is subjected to exposure and developing to form a toner image thereon, and another electroconductive roller supplied with a voltage is pressed against the electrostatic image-bearing member while a transfer material is passed therebetween, whereby the toner image on the electrostatic image-bearing member is transferred onto the transferred and subjected to a fixing step to form a transferred and fixed image.

However, according to such a roller transfer scheme not using corona discharge wherein a transfer charging member is pressed against a photosensitive member (electrostatic image-bearing member) via a transfer material at the time of transfer, a toner image on the photosensitive member is compressed at the time of transfer onto the transfer material, thereby causing a partial transfer failure so-called "hollow image" or "transfer dropout".

Further, as the toner is reduced in particle size, the forces of attaching toner particles onto the photosensitive member (such as image force and van der Walls force) become predominant compared with Coulomb force acting on the toner particles for transfer, whereby the transfer residual toner is liable to be increased.

Further, in such a roller charging scheme, physical and chemical actions of discharge occurring between the charging roller and the photosensitive member become intense than in the corona charging scheme, so that the photosensitive member surface is liable to be worn due to deterioration of the photosensitive member surface, thus leaving a problem regarding the life of the photosensitive member, especially in the combination of an organic photosensitive member and a blade cleaning member.

Accordingly, such an image forming system using a contact charging scheme, the toner and the electrostatic image-bearing member are both required to exhibit excellent releasability.

The above-mentioned various performances required of a toner are mostly contradictory with each other but are being required to be satisfied at high levels in combination in recent years. Accordingly, comprehensive studies further inclusive of one on developing performance are being made but they are not yet sufficient.

SUMMARY OF THE INVENTION

Accordingly, a generic object of the present invention is to provide a toner for developing electrostatic images capable of solving the above-mentioned problems.

A more specific object of the present invention is to provide a toner for developing electrostatic images having excellent fixability and anti-offset property.

Another object of the present invention is to provide a toner for developing electrostatic images capable of stably providing high-quality images for a long period of time without adversely affecting members, such as an electrostatic image-bearing member and a toner-carrying member, and further an intermediate transfer member, if any.

A further object of the present invention is to provide an image forming method using a toner as described above.

According to the present invention, there is provided a toner for developing an electrostatic image, comprising: toner particles each containing at least a binder resin, a colorant and a wax; wherein the toner has a number-average particle size of 2–6 μm and a standard deviation in particle size of below 2.6 μm based on a number-basis distribution of circle-equivalent diameters, an average circularity of 0.970–0.995 and a standard deviation in circularity of below 0.030 based on a circularity frequency distribution, and a residual monomer content of at most 500 ppm; and the toner particles have such a microtexture as to provide a particle cross section as observed through a transmission electron microscope (TEM) exhibiting a matrix of the binder resin and a particle of the wax dispersed in a discrete form in the matrix of the binder resin.

According to another aspect of the present invention, there is provided an image forming method, comprising:

a charging step of charging an image-bearing member, an electrostatic image forming step of forming an electrostatic image on the charged image-bearing member;

a developing step of developing the electrostatic image with a toner carried on a developer-carrying member to form a toner image on the image bearing member, a first transfer step of transferring the toner image on the image-bearing member to an intermediate transfer member, a second transfer step of transferring the toner image on the intermediate transfer member onto a recording material, and a fixing step of heat-fixing the toner image on the recording material.

According to a further aspect of the present invention, there is provided an image forming method, comprising:

a charging step of charging an image-bearing member, an electrostatic image forming step of forming an electrostatic image on the charged image-bearing member;

a developing step of developing the electrostatic image with the above-mentioned toner carried on a developer-carrying member to form a toner image on the image bearing member, a transfer step of transferring the toner image on the image-bearing member onto a recording material, and a fixing step of heat-fixing the toner image on the recording material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
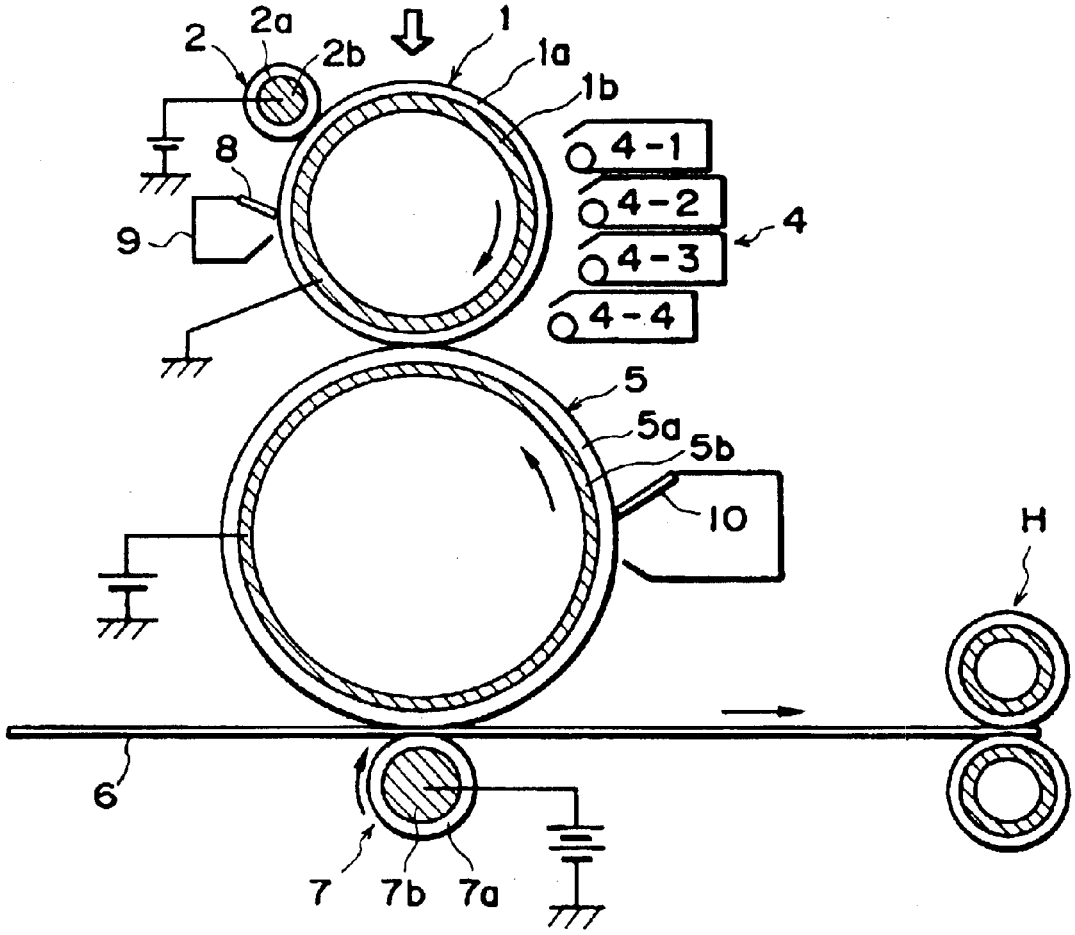
FIG. 1 schematically illustrates an example of image forming apparatus suitably used for practicing an embodiment of the image forming method of the invention.

According to our study, it has been discovered that the particle size frequency distribution and circularity frequency distribution of toner particles have a great influence on the developing performance and transferability of the toner.

Thus, it has been found possible to improve the transferability and the developing performance in good balance by accurately controlling the particle size distribution and particle shape of toner particles so as to provide a number-average particle size of 2–6 μm and a standard deviation in particle size of below 2.6 μm based on a number-basis distribution of circle-equivalent diameters, and an average circularity of 0.970–0.995 and a standard deviation in circularity of below 0.030 based on a circularity frequency distribution.

More specifically, by decreasing the toner size so as to provide a circle-equivalent number-average particle size (diameter) of 2–6 μm based on a number-basis particle size frequency distribution of the toner, it becomes possible to provide a good reproducibility of image contour, particularly in development of character images and line pattern. However, it is a general tendency that, when toner particles are reduced in particle size, the proportion of fine particle size toner is naturally increased, so that the uniform charging of toner particles becomes difficult to result in image fog and the toner attachment force onto the surface of the electrostatic image-bearing member increases to result in an increased amount of transfer residual toner.

However, the toner according to the present invention is provide with good stability of developing performance and transferability against a change in environmental conditions, and also good continuous image forming performance, as the toner is provided with a uniform particle size and a uniform shape as represented by a standard deviation in particle size of below 2.6 μm and a standard deviation in circularity of below 0.030.

We consider that the improvement may be attributable to a mechanism that the toner according to the present invention can form a thin toner layer with a sufficient coating rate in the development step even if the regulating force exerted by a toner layer thickness-regulating member is enhanced compared with an ordinary level, so that the toner on the toner-carrying member can be provided with an increased triboelectric charge without damaging the toner-carrying member.

Further, by controlling the average circularity of the toner within 0.970–0.995, preferably within 0.980–0.995, the transferability of a small-particle size toner can be remarkably improved while it has been difficult heretofore, and also the toner has become possible to exhibit a remarkably improved developing performance for a low-potential latent image. This is particularly effective for developing minute spot latent image formed in the digital scheme.

If the average circularity is below 0.970, the transferability becomes inferior and the developing performance is lowered in case of a small particle size toner as in the present invention. If the average circularity exceeds 0.995, the toner surface deterioration becomes pronounced, to result in a problem in continuous image forming performance.

The circle-equivalent diameter, circularity and their distributions of a toner described herein for defining the toner according to the present invention are based on values measured by using a flow particle image analyzer ("FPIA-1000", available from Toa Iyou Denshi K.K.) in the following manner.

Into ca. 10 ml of a solution (at 20° C.) formed by adding 0.1–0.5 wt. % of a surfactant (a commercially available preferred example thereof being "CONTAMINON", mfd by Wako Junyaku K.K.) into deionized water from which fine dirt has been removed by passing through a filter so as to reduce the number of contaminant particles having particle sizes in the measurement range (i.e., circle-equivalent diameters of 0.60 μm (inclusive) to 159.21 μm (not inclusive)) to at most 20 particles, ca. 0.02 g of a sample is added and uniformly dispersed by means of an ultrasonic disperser ("UH-50" including a vibrator having a 5 mm-dia. titanium alloy tip, available from K.K. SMT) for at least 5 min., while cooling the dispersion medium, as desired, so that the temperature will not exceed 40° C. The resultant sample dispersion liquid is subjected to measurement of particle size distribution and circularity distribution of particles in a circle-equivalent diameter range of 0.60–159.21 μm (upper limit, not inclusive) by using the above-mentioned flow particle image analyzer.

The details of the measurement is described in a technical brochure and an attached operation manual on "FPIA-1000" published from Toa Iyou Denshi K.K. (Jun. 25, 1995) and JP-A 8-136439. The outline of the measurement is as follows.

A sample dispersion liquid is caused to flow through a flat thin transparent flow cell (thickness=ca. 200 μm) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two dimensional image having a certain area parallel to the flow cell. From the two-dimensional image area of each particle, a diameter of a circle having an identical area (an equivalent circle) is determined as a circle-equivalent diameter. Further, for each particle, a peripheral length of the equivalent circle is determined and divided by a peripheral length measured on the two-dimensional image of the particle to determine a circularity of the particle. The results (frequency % and cumulative %) may be given for 226 channels in the range of 0.60 μm–400.00 μm (30 channels (divisions) for one octave) as shown in the following Table 1 (for each channel, the lower limit size value is included and the upper limit size value is excluded), whereas particles having circle-equivalent diameters in a range of 0.60 μm–159.21 μm (upper limit, not inclusive) are subjected to an actual measurement.

TABLE 1

| Circle-equivalent diameter (C.E.D.) ranges for respective channels (Ch) | |
|---|---|
| Ch | C.E.D. range (μm) |
| 1 | 0.60–0.61 |
| 2 | 0.61–0.63 |
| 3 | 0.63–0.65 |
| 4 | 0.65–0.67 |
| 5 | 0.67–0.69 |
| 6 | 0.69–0.71 |
| 7 | 0.71–0.73 |
| 8 | 0.73–0.75 |
| 9 | 0.75–0.77 |
| 10 | 0.77–0.80 |
| 11 | 0.80–0.82 |
| 12 | 0.82–0.84 |
| 13 | 0.84–0.87 |
| 14 | 0.87–0.89 |
| 15 | 0.89–0.92 |
| 16 | 0.92–0.95 |
| 17 | 0.95–0.97 |
| 18 | 0.97–1.00 |
| 19 | 1.00–1.03 |
| 20 | 1.03–1.06 |
| 21 | 1.06–1.09 |
| 22 | 1.09–1.12 |
| 23 | 1.12–1.16 |
| 24 | 1.16–1.19 |
| 25 | 1.19–1.23 |
| 26 | 1.23–1.26 |
| 27 | 1.26–1.30 |
| 28 | 1.30–1.34 |
| 29 | 1.34–1.38 |
| 30 | 1.38–1.42 |
| 31 | 1.42–1.46 |
| 32 | 1.46–1.50 |
| 33 | 1.50–1.55 |
| 34 | 1.55–1.59 |
| 35 | 1.59–1.64 |
| 36 | 1.64–1.69 |
| 37 | 1.69–1.73 |
| 38 | 1.73–1.79 |
| 39 | 1.79–1.84 |
| 40 | 1.84–1.89 |
| 41 | 1.89–1.95 |
| 42 | 1.95–2.00 |
| 43 | 2.00–2.06 |
| 44 | 2.06–2.12 |
| 45 | 2.12–2.18 |
| 46 | 2.18–2.25 |
| 47 | 2.25–2.31 |
| 48 | 2.31–2.38 |
| 49 | 2.38–2.45 |
| 50 | 2.45–2.52 |
| 51 | 2.52–2.60 |
| 52 | 2.60–2.67 |
| 53 | 2.67–2.75 |
| 54 | 2.75–2.83 |
| 55 | 2.83–2.91 |
| 56 | 2.91–3.00 |
| 57 | 3.00–3.09 |
| 58 | 3.09–3.18 |
| 59 | 3.18–3.27 |
| 60 | 3.27–3.37 |
| 61 | 3.37–3.46 |
| 62 | 3.46–3.57 |
| 63 | 3.57–3.67 |
| 64 | 3.67–3.78 |
| 65 | 3.78–3.89 |
| 66 | 3.89–4.00 |

TABLE 1-continued

| Circle-equivalent diameter (C.E.D.) ranges for respective channels (Ch) | |
|---|---|
| Ch | C.E.D. range (μm) |
| 67 | 4.00–4.12 |
| 68 | 4.12–4.24 |
| 69 | 4.24–4.36 |
| 70 | 4.36–4.49 |
| 71 | 4.49–4.62 |
| 72 | 4.62–4.76 |
| 73 | 4.76–4.90 |
| 74 | 4.90–5.04 |
| 75 | 5.04–5.19 |
| 76 | 5.19–5.34 |
| 77 | 5.34–5.49 |
| 78 | 5.49–5.65 |
| 79 | 5.65–5.82 |
| 80 | 5.82–5.99 |
| 81 | 5.99–6.16 |
| 82 | 6.16–6.34 |
| 83 | 6.34–6.53 |
| 84 | 6.53–6.72 |
| 85 | 6.72–6.92 |
| 86 | 6.92–7.12 |
| 87 | 7.12–7.33 |
| 88 | 7.33–7.54 |
| 89 | 7.54–7.76 |
| 90 | 7.76–7.99 |
| 91 | 7.99–8.22 |
| 92 | 8.22–8.46 |
| 93 | 8.46–8.71 |
| 94 | 8.71–8.96 |
| 95 | 8.96–9.22 |
| 96 | 9.22–9.49 |
| 97 | 9.49–9.77 |
| 98 | 9.77–10.05 |
| 99 | 10.05–10.35 |
| 100 | 10.35–10.65 |
| 101 | 10.65–10.96 |
| 102 | 10.96–11.28 |
| 103 | 11.28–11.61 |
| 104 | 11.61–11.95 |
| 105 | 11.95–12.30 |
| 106 | 12.30–12.66 |
| 107 | 12.66–13.03 |
| 108 | 13.03–13.41 |
| 109 | 13.41–13.80 |
| 110 | 13.80–14.20 |
| 111 | 14.20–14.62 |
| 112 | 14.62–15.04 |
| 113 | 15.04–15.48 |
| 114 | 15.48–15.93 |
| 115 | 15.93–16.40 |
| 116 | 16.40–16.88 |
| 117 | 16.88–17.37 |
| 118 | 17.37–17.88 |
| 119 | 17.88–18.40 |
| 120 | 18.40–18.94 |
| 121 | 18.94–19.49 |
| 122 | 19.49–20.06 |
| 123 | 20.06–20.65 |
| 124 | 20.65–21.25 |
| 125 | 21.25–21.87 |
| 126 | 21.87–22.51 |
| 127 | 22.51–23.16 |
| 128 | 23.16–23.84 |
| 129 | 23.84–24.54 |
| 130 | 24.54–25.25 |
| 131 | 25.25–25.99 |
| 132 | 25.99–26.75 |
| 133 | 26.75–27.53 |
| 134 | 27.53–28.33 |
| 135 | 28.33–29.16 |
| 136 | 29.16–30.01 |
| 137 | 30.01–30.89 |
| 138 | 30.89–31.79 |
| 139 | 31.79–32.72 |
| 140 | 32.72–33.67 |

TABLE 1-continued

| Circle-equivalent diameter (C.E.D.) ranges for respective channels (Ch) | |
|---|---|
| Ch | C.E.D. range (μm) |
| 141 | 33.67–34.65 |
| 142 | 34.65–35.67 |
| 143 | 35.67–36.71 |
| 144 | 36.71–37.78 |
| 145 | 37.78–38.88 |
| 146 | 38.88–40.02 |
| 147 | 40.02–41.18 |
| 148 | 41.18–42.39 |
| 149 | 42.39–43.62 |
| 150 | 43.62–44.90 |
| 151 | 44.90–46.21 |
| 152 | 46.21–47.56 |
| 153 | 47.56–48.94 |
| 154 | 48.94–50.37 |
| 155 | 50.37–51.84 |
| 156 | 51.84–53.36 |
| 157 | 53.36–54.91 |
| 158 | 54.91–56.52 |
| 159 | 56.52–58.17 |
| 160 | 58.17–59.86 |
| 161 | 59.86–61.61 |
| 162 | 61.61–63.41 |
| 163 | 63.41–65.26 |
| 164 | 65.26–67.16 |
| 165 | 67.16–69.12 |
| 166 | 69.12–71.14 |
| 167 | 71.14–73.22 |
| 168 | 73.22–75.36 |
| 169 | 75.36–77.56 |
| 170 | 77.56–79.82 |
| 171 | 79.82–82.15 |
| 172 | 82.15–84.55 |
| 173 | 84.55–87.01 |
| 174 | 87.01–89.55 |
| 175 | 89.55–92.17 |
| 176 | 92.17–94.86 |
| 177 | 94.86–97.63 |
| 178 | 97.63–100.48 |
| 179 | 100.48–103.41 |
| 180 | 103.41–106.43 |
| 181 | 106.43–109.53 |
| 182 | 109.53–112.73 |
| 183 | 112.73–116.02 |
| 184 | 116.02–119.41 |
| 185 | 119.41–122.89 |
| 186 | 122.89–126.48 |
| 187 | 126.48–130.17 |
| 188 | 130.17–133.97 |
| 189 | 133.97–137.88 |
| 190 | 137.88–141.90 |
| 191 | 141.90–146.05 |
| 192 | 146.05–150.31 |
| 193 | 150.31–154.70 |
| 194 | 154.70–159.21 |
| 195 | 159.21–163.86 |
| 196 | 163.86–168.64 |
| 197 | 168.64–173.56 |
| 198 | 173.56–178.63 |
| 199 | 178.63–183.84 |
| 200 | 183.84–189.21 |
| 201 | 189.21–194.73 |
| 202 | 194.73–200.41 |
| 203 | 200.41–206.26 |
| 204 | 206.26–212.28 |
| 205 | 212.28–218.48 |
| 206 | 218.48–224.86 |
| 207 | 224.86–231.42 |
| 208 | 231.42–238.17 |
| 209 | 238.17–245.12 |
| 210 | 245.12–252.28 |
| 211 | 252.28–259.64 |
| 212 | 259.64–267.22 |
| 213 | 267.22–275.02 |
| 214 | 275.02–283.05 |

TABLE 1-continued

| Circle-equivalent diameter (C.E.D.) ranges for respective channels (Ch) | |
|---|---|
| Ch | C.E.D. range (μm) |
| 215 | 283.05–291.31 |
| 216 | 291.31–299.81 |
| 217 | 299.81–308.56 |
| 218 | 308.56–317.56 |
| 219 | 317.56–326.83 |
| 220 | 326.83–336.37 |
| 221 | 336.37–346.19 |
| 222 | 346.19–356.29 |
| 223 | 356.29–366.69 |
| 224 | 366.69–377.40 |
| 225 | 377.40–388.41 |
| 226 | 388.41–400.00 |

The circularity of a toner particle described herein is a measure of roundness of the particle, provides a value of 1.000 for a perfectly spherical toner particle and provides a smaller value as the surface shape becomes complex.

A circle-equivalent number-average particle size $\overline{d_1}$ and a particle size standard deviation $SD_d$ of a sample toner can be calculated according to the following formulae from a measured number basis particle size distribution including a central value of circle-equivalent diameter $d_i$ for each channel i (i=1 to n) and a measured frequency $f_i$ for the channel i:

$$\overline{d_1} = \sum_{i=1}^{n} (f_i \times d_i) \Big/ \sum_{i=1}^{n} (f_i)$$

$$SD_d = \left\{ \sum_{i=1}^{n} (\overline{d_1} - d_i)^2 \Big/ \sum_{i=1}^{n-1} (f_i) \right\}^{1/2}$$

Further, an average circularity $\overline{C}$ and a circularity standard deviation $SD_c$ of a sample toner can be calculated according to the following formula based on measured circularity ($C_i$) for each of a plurality (i=1 to n) of measured toner paraticles:

$$\overline{C} = \sum_{i=1}^{m} C_i / m$$

$$SD_c = \left\{ \sum_{i=1}^{m} (\overline{C} - C_i)^2 / m \right\}^{1/2}$$

Further, the toner according to the present invention is caused to have a reduced residual monomer content of at most 500 ppm, preferably at most 200 ppm, more preferably at most 150 ppm, further preferably at most 50 ppm. If the residual monomer content in the toner exceeds 500 ppm, the toner becomes problematic in respects of chargeability and anti-blocking property.

The residual monomer can remain as a non-reacted portion of monomer in a toner, when a binder resin is produced or toner particles are produced by direct polymerization in a manner described hereinafter.

A known technique may be used for reducing the residual monomer content in the toner according to the present invention. For example, during polymerization for producing a binder resin or for directly producing a toner, the residual monomer content may be suppressed by appropriately controlling the manner of initiator addition or the reaction temperature, or by effecting distillation after the polymerization. Further, in the case of toner production through the pulverization process, it is possible to reduce the residual monomer content relatively effectively by exerting a reduced pressure during melt-kneading the starting materials under heating in a kneader, etc. It is also effective to perform spray drying after a polymerization process for toner production. Particularly, in the case of toner production through suspension polymerization, the monomer reduction can also be effected during drying under heating of toner particles, e.g., by stirring under heating at a reduced pressure in a conical blender-type drying machine. During an ordinary step of drying toner particles, only moisture is removed from the toner, but if the stirring condition and processing period are appropriately controlled, not only the removal of residual monomer but also sphering of toner particles can be effected simultaneously, thus providing a preferable toner shape. For example, the provision of a desired toner shape while reducing the residual monomer content to 500 ppm or below may be performed by heating toner particles for 4 or more hours under a reduced pressure of at most 13.3 kPa (100 Torr) in a temperature range of from 35° C. to a glass transition temperature (Tg) of the binder resin. Under such treatment conditions, a conventional toner has posed a difficulty in removal of the residual monomer or caused a problem of agglomeration or coalescence of toner particles, but the toner according to the present invention allows a relatively easy removal of the residual toner from interior of toner particles and minimizes the coarsening of toner particles or adverse effect of the wax during a sphering treatment of toner particles as described above because of the specification of dispersion state and thermal property of the wax as described hereinafter.

The quantitative measurement of the residual monomer in a toner may be effected by using a known method, such as (1) a thermogravimetric (TG) method for measuring a weight loss under heating by using a thermobalance, etc., or (2) a method using gas chromatography. Of these, it is particularly effective to use gas chromatography.

In case of quantitative analysis according to the TG method, the residual monomer content in a sample toner is measured as a weight loss caused by heating the sample toner up to 200° C. A specific example of the TG method is shown below.

Measurement According to TG

Apparatus: "TGA-7" or "PE7700" (available from Perkin-Elmer Corp.)

Temperature increase rate: 10° C./min

Measurement environment: $N_2$

On the other hand, the determination of a residual monomer content in a toner according to GC may for example be performed in the following manner.

Measurement According to GC

Apparatus: "GC-14A" (available from Shimadzu Seisakusho K.K.)

Column: Fused silica capillary column (mfd. by J&W SCIENTIFIC Co.; size: 30 m×0.249 mm, liquid phase: DBWAX, thickness: 0.25 μm)

Sample: A solvent containing an internal standard is prepared by adding 100 ml of acetone to 2.55 mg of DMF as the internal standard. Then, 400 mg of a sample toner is dispersed in the solvent to prepare 10 ml of a sample liquid, which is then subjected to ultrasonic vibration for 30 min., followed by 1 hour of standing and filtration through a 0.5 μm-filter, to provide a sample liquid. Then, 4 μl of the sample liquid is injected for GC measurement.

Detector: FID (split ratio=1:20)

Carrier gas: $N_2$

Oven temp.: 2 min of waiting at 70° C., followed by heating at a rate of 5° C./min up to 220° C.

Injection port temp.: 200° C.

Detector temp.: 200° C.

Preparation of a calibration curve: Standard samples are prepared by adding different amounts of an objective monomer into a solvent containing an internal standard identical to the one used for preparing a sample liquid and subjected to a similar GC measurement. For each standard sample, a weight ratio (known based on added amounts) and an areal ratio (measured on a gas chromatogram) are determined between the objective monomer and the internal standard (DMF). The weight ratio is plotted versus the areal ratio for several standard values to prepare a calibration curve.

The wax (component) in the toner according to the present invention is dispersed or enclosed in a matrix of the binder resin as a discrete particle or in an island form, preferably in a spherical shape or a spindle shape, not dissolved with the matrix binder resin, when a cross section of the toner particle is observed through a transmission electron microscope (TEM).

Figure 5A:
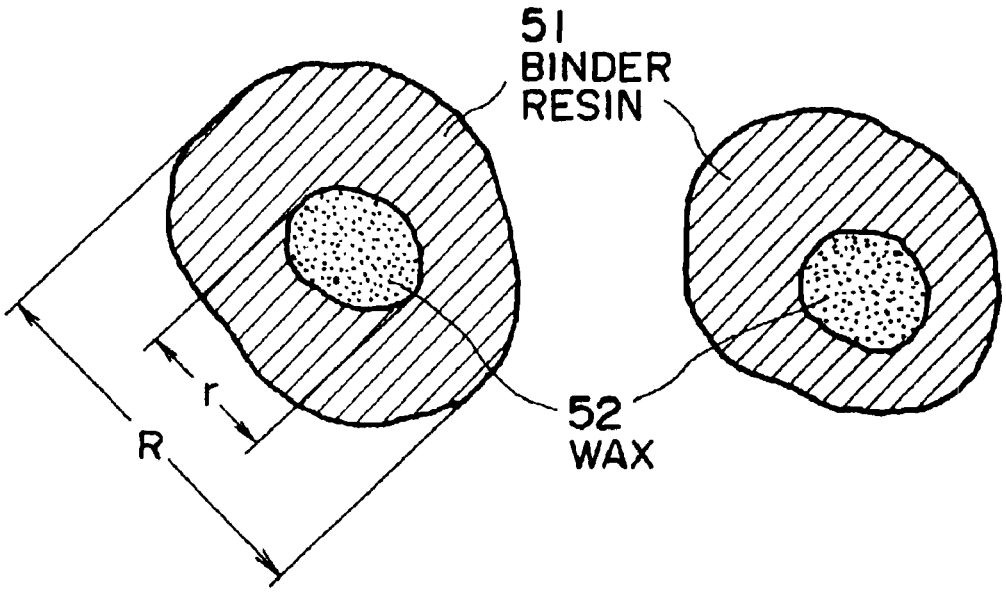
FIGS. 5A and 5B are schematic illustrations each showing a state of dispersion of wax particles in toner particles.
Figure 5B:
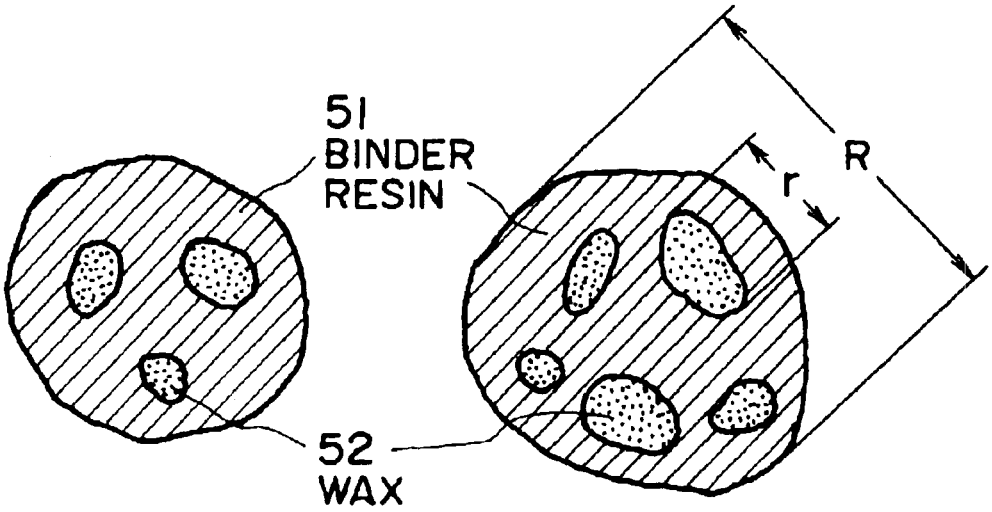
Figure 10:
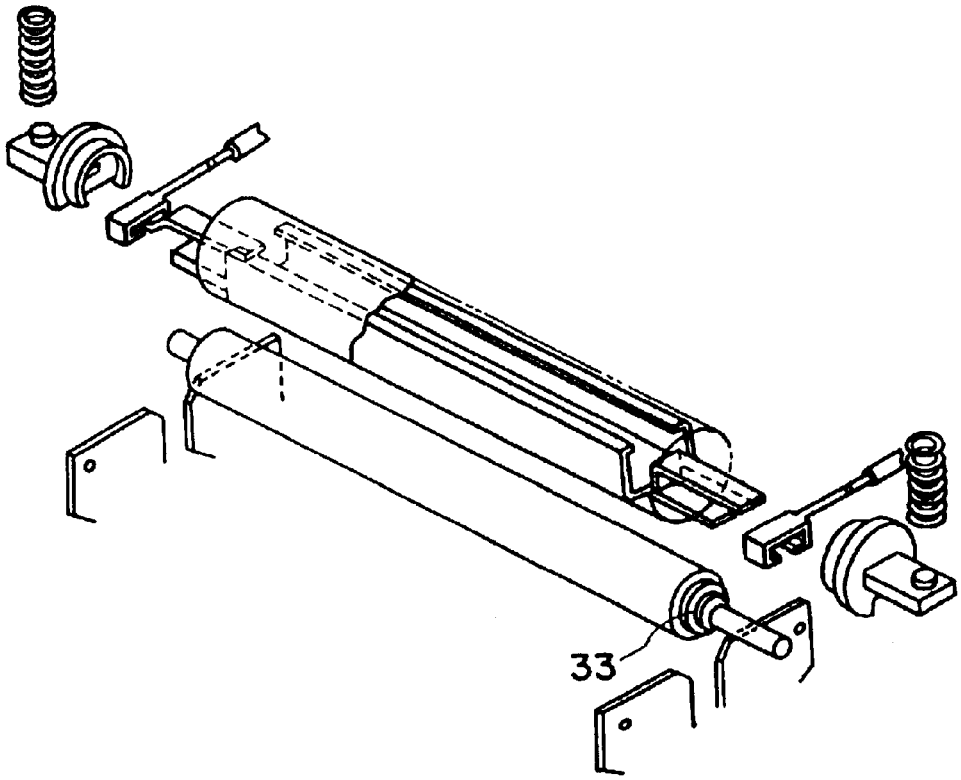
FIG. 10 is an exploded perspective view of essential parts of a heat-pressure fixing apparatus used in an embodiment of the invention.

The wax dispersion state in the toner according to the present invention may preferably be defined as follows. That is, a weight-average circle-equivalent diameter is determined based on the above-mentioned flow particle image analyzer (FPIA) measurement and denoted by D4 (μm). Then, sliced toner particles embedded within an epoxy resin are photographed through a TEM to obtain photographs as illustrated in FIGS. 5A and 5B, and 10, wherein arbitrarily selected toner particle cross section samples each having a longer-axis diameter R falling within a range of D4×0.9 to D4×1.1 are selected on the photographs. For each toner particle cross section showing a longer axis diameter R, a wax particle having the largest longer-axis diameter r among plural wax particles, if any, enclosed therein is selectively determined. For the 10 toner particle cross sectional views, an average ratio r/R is taken, and if the average is in the range of 0.05–0.95 (i.e., $0.05 \leqq (r/R)_{av.} \leqq 0.95$), the presence of wax particle(s) discretely or insolubly dispersed or enclosed within the matrix binder resin, is confirmed. This state may also be regarded as a dispersion in the form of an island of a spherical or spindle shape.

By establishing a wax dispersion or enclosure state as described above, it is possible to effectively prevent the toner deterioration and soling with toner of image forming apparatus. Particularly, in the case of $0.25 \leqq (r/R)_{av.} \leqq 0.90$, it is possible to retain a good chargeability and provide toner images with excellent dot reproducibility for a long period. Further, as the wax effectively functions under heating, it is possible to attain satisfactory low-temperature fixability and anti-offset property.

The cross section of toner particles defining the toner according to the present invention may be observed through a TEM in the following manner. Sample toner particles are sufficiently dispersed in a cold-setting epoxy resin, which is then hardened for 2 days at 40° C. The hardened product is then dyed with triruthenium tetroxide and sliced into thin flakes by a microtome having a diamond cutter. The resultant thin flake samples in a number sufficient to provide a required number of toner particle cross sections are observed and photographed through a transmission electron microscope (TEM) at a magnification of e.g., $10^4$–$10^5$. The dyeing with triruthenium tetroxide may preferably be used in order to provide a contrast between the wax and the binder resin by utilizing some difference in crystallinity therebetween, thereby confirming a desired wax dispersion or enclosure state. Representative wax dispersion states obtained by Examples described hereinafter are shown in FIGS. 5A and 5B, wherein the desired dispersion or enclosure state of wax particles 52 within an outer shell resin or matrix binder resin 51 is observed.

The wax (component) used in the present invention may preferably exhibit such a thermal behavior as to provide a DSC curve obtained by means of a differential scanning calorimeter, showing a maximum heat-absorption peak in a range of 50–100° C. in the course of temperature increase, an onset temperature at rising of a heat absorption peak including the maximum heat-absorption peak of at least 40° C., and a temperature difference of 7–50° C. between the maximum heat-absorption peak temperature and the onset temperature.

By using a wax showing the above-mentioned thermal behavior based on its DSC curve on temperature increase, it becomes possible to improve the dispersibility of other additives and easily control the above-mentioned dispersion states of the wax per se.

As a result, the resultant toner can exhibit good fixability as a matter of course, and improved release effect due to the wax, thus ensuring a sufficient fixable temperature region, while obviating adverse effects accompanying the use of a wax on developing performance, anti-blocking property and image forming apparatus. Particularly, as the specific surface area of a toner is lowered as the toner particle shape approaches a sphere, the control of wax dispersion state becomes very effective.

The DSC measurement of a wax or a toner may preferably be performed by using a scanning calorimeter of high-accuracy internal heat-input compensation-type so as to observe heat input to and heat evolution from a wax and its behavior. For example, it is possible to use "DSC-7" available from Perkin-Elmer Corp.

The measurement may be performed according to ASTM D3418-82. In case of obtaining a DSC curve of a wax alone, the sample is first subjected to one cycle of temperature increase-decrease so as to remove its thermal history and then to a DSC measurement on temperature increase at a temperature-raising rate of 10° C./min. In case of obtaining a DSC curve of a wax in a state of being contained in a toner, the sample toner may be subjected to a DSC measurement without effecting a thermal history removal treatment.

Figure 6:
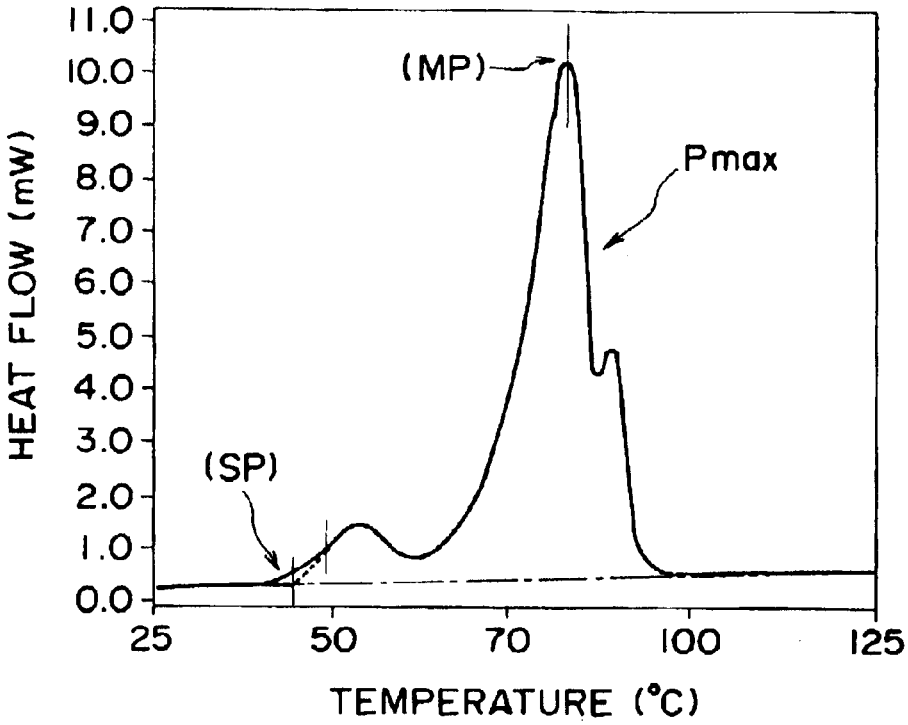
FIG. 6 illustrates a DSC curve on temperature increase of a wax used in a toner according to the invention.

Some temperatures characterizing a wax used in the present invention may be defined as follows with reference to FIG. 6 showing an example of DSC curve.

Maximum Heat-Absorption Peak Temperature

On a DSC curve on temperature increase as shown in FIG. 6, a peaktop temperature (corresponding to MP in FIG. 6) of a maximum heat-absorption peak is taken in a temperature region of 50–100° C.

Heat-Absorption Peak Onset Temperature

A temperature (corresponding to SP in FIG. 6) at an intersection of a base line and a tangential line on a DSC curve on temperature increase at a point where the differential of the DSC curve first assumes a maximum, is taken.

Examples of the wax (component) used in the present invention may include: waxes of petroleum origin, such as paraffin wax, microcrystalline wax and petrolactam, and derivatives thereof; montan wax and derivatives thereof, hydrocarbon wax obtained through the Fischer-Tropsch process and derivatives thereof, polyolefin waxes as represented by polyethylene and derivatives thereof, carnauba wax, candelilla wax, natural wax, and derivatives of these waxes, wherein the derivatives may include oxides, block copolymers with vinyl monomer, and graft products. Further examples may include: alcohols, such as higher fatty alcohols, fatty acids, such as stearic acid and palmitic acid, and compounds thereof; acid amides, esters, ketones, hardened castor oil and derivatives thereof, vegetable waxes, and animal waxes. These waxes or wax components may be used singly or in combination.

Among these, it is preferred to use polyolefin, hydrocarbon wax obtained through the Fischer-Tropsch process, petroleum wax, higher alcohol or higher ester, in order to provide further improved developing performance and transferability.

The wax (component) can contain an anti-oxidant within an extent of not adversely affecting the toner chargeability.

The wax (component) may preferably be used in 1–30 wt. parts, more preferably be 4–20 wt. parts, per 100 wt. parts of the binder resin.

Examples of the binder resin used in the present invention may include: styrene-(meth)acrylate copolymer, polyester resin, epoxy resin and styrene-butadiene copolymer as generally used. In the process of producing toner particles directly through polymerization, monomers of such binder resins are used. Examples thereof may include: styrene monomers, such as styrene, o-, m- or p-methylstyrene, and m- or p-ethylstyrene; (meth)acrylate ester monomers, such as methyl (meth)acrylate, ethyl (meth)acrylate, propyl (meth)acrylate, butyl (meth)acrylate, octyl (meth)acrylate, dodecyl (meth)acrylate, stearyl (meth)acrylate, behenyl (meth)acrylate, 2-ethylhexyl (meth)acrylate, methylaminoethyl (meth)acrylate, and diethylaminoethyl (meth)acrylate; butadiene, isoprene, cyclohexene, (meth)acrylonitrile, and acrylamide. These monomers may be used singly or in mixtures so as to provide a polymer giving a theoretical glass transition temperature (Tg) described in Polymer Handbook, Second Edition, III, pp. 139–192 (John Wilery & Sons) of 40–75° C. If the theoretical glass transition temperature is below 40° C., the resultant toner is liable to suffer from difficulties with respect to storage stability and continuous image forming stability. On the other hand, in excess of 75° C., the toner shows an increased fixable temperature. This is particularly undesirable for color toners for forming full-color images, as the color mixability of the respective color toners is lowered to result in inferior color reproducibility and OHP images with lowered transparency.

The molecular weight (distribution) of a binder resin may be measured by gel permeation chromatography (GPC). In a specific GPC measurement for a toner containing a wax enclosed therein as in the present invention, a sample toner is once subjected to 20 hours of extraction with toluene solvent by means of a Soxhlet's extractor, and the toluene is evaporated off from the extract solution by a rotary evaporator to recover the extract, which is then sufficiently washed with an organic solvent (e.g., chloroform) capable of dissolving the wax (component) but not dissolving the binder resin. Then, the remaining solid binder resin is dissolved in tetrahydrofuran (THF), and the resultant solution is filtrated through a solvent-resistant membrane filter having a pore size (diameter) of 0.2 $\mu$m to prepare a sample solution, which is then subjected to GPC by using, e.g., a GPC apparatus (e.g., "GPC-150C", available from Waters Co.). The sample solution may be prepared so as to provide a binder resin concentration of 0.05–0.6 wt. %. The sample solution may be injected in an amount of 50–200 $\mu$l. The columns may comprise a series of, e.g., A-801, 802, 803, 804, 805, 806 and 807 available from Showa Denko K.K., and a calibration cure for providing a molecular weight distribution may be prepared by using standard polystyrenes. The binder resin used in the present invention may preferably have a main-peak molecular weight (Mp) of $5\times10^3$–$10^6$ and a ratio (Mw/Mn) between weight-average molecular weight (Mw) and number-average (Mn) of 2–100.

In the present invention, the above-mentioned principally vinyl-type binder resin may be used in combination with a polar resin, such as polyester or polycarbonate. It is particularly preferred to use a polycarbonate resin having a recurring unit represented by formula (I) below, so as to provide a toner with improved chargeability, suppressed liability of image fog and scattering, and ability of providing high-quality images with excellent dot reproducibility. Further, the toner is provided with an appropriate level of mechanical strength, whereby improved matching with image forming apparatus is attained, and toner deterioration is minimized during a drying step as mentioned above or a sphering step:

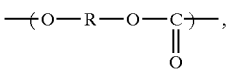

(I)

wherein R denotes an organic group. The recurring unit of the formula (I) may assume various forms inclusive of those produced through reaction between dihydric phenols and carbonate precursors in solution or in a molten state. A specific example thereof may be represented by the following formula (II):

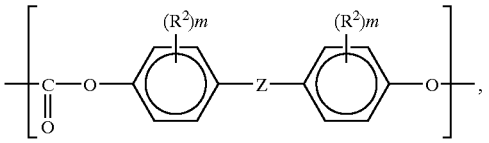

(II)

wherein $R^2$ is hydrogen atom, aliphatic hydrocarbon group or aromatic hydrocarbon group; m is 0–4 with the proviso that in case of m≧2, a plurality of groups $R^2$ can be the same or different; Z denotes a single bond, a bond derived from a substituent to an aromatic ring, or a bond as represented by —S—, —SO—, —$SO_2$—, —O— or —CO—.

Such polycarbonate resins may be produced through various reactions but may ordinarily be easily produced through a reaction between a dihydric phenol represented by any of the following formulae (III)–(V) with a carbonate precursor, such as phosgene or a carbonate ester compound.

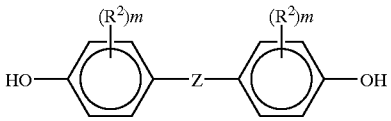

(III)

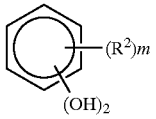

(IV)

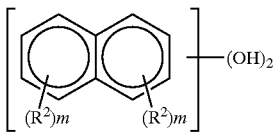

(V)

wherein $R^2$, m and Z are the same as in the formula (II). More specifically, a dihydric phenol and a carbonate precursor such as phosgene are reacted with each other in the presence of a known acid acceptor or molecular weight control agent in a solvent such as methylene chloride, or a dihydric phenol and a carbonate precursor such as diphenyl carbonate are subjected to an ester exchange reaction.

The hydric phenols represented by the above formulae (III)-(V) may assume various forms, and examples thereof may include: dihydroxydiarylalkanes, 2,2-bis(4-hydroxyphenyl)propane (generally called, "bisphenol A") as a representative one, further bis(4-hydroxyphenyl)methane, bis(4-hydroxyphenyl)phenyl-methane, bis(4-hydroxyphenyl)naphthylmethane, bis(4-hydroxyphenyl)-(4-isopropylphenyl)methane, bis(3,5-dimethyl-4-hydroxyphenyl)methane, 1,1-bis(4-hydroxyphenyl)ethane, 1-naphthyl-1,1-(bis(4-hydroxyphenyl)ethane, 1-phenyl-1,1-bis(4-hydroxyphenyl)ethane, 1,2-bis(4-hydroxyphenyl) ethane, 2-methyl-1,1-bis(4-hydroxyphenyl)propane, 2,2-bis (3,5-dimethyl-5-hydroxyphenyl)propane, 1-ethyl-1,1-bis(4-hydroxyphenyl)propane, 2,2-bis(3-methyl-4-hydroxyphenyl)propane, 1,1-bis(4-hydroxyphenyl)butane, 2,2-bis(4-hydroxyphenyl)butane, 1,4-bis(4-hydroxyphenyl) butane, 2,2-bis(4-hydroxyphenyl)pentane, 4-methyl-2,2-bis (4-hydroxyphenyl)pentane, 1,1-bis(4-hydroxyphenyl) cyclohexane, 2,2-bis(4-hydroxyphenyl)-hexane, 4,4-bis(4-hydroxyphenyl)heptane, 2,2-bis(4-hydroxyphenyl)nonane, 1-10-bis(4-hydroxyphenyl)decane, and 1,1-bis(4-hydroxyphenyl)cyclodecane; dihydroxyaryl sulfones, such as bis(4-hydroxyphenyl)sulfone, and bis(3,5-dimethyl-4-hydroxyphenyl)sulfone; dihydroxyaryl ethers, such as bis (4-hydroxyphenyl)-ether, and bis(3,5-dimethyl-4-hydroxyphenyl)ether; dihydroxyaryl ketones, such as 4,4'-dihydroxybenzo-phenone, and 3,3',5,5'-tetramethyl-4,4'-dihydroxy-benzophenone; dihydroxyaryl sulfides, such as bis(4-hydroxyphenyl) sulfide, bis(3-methyl-4-hydroxyphenyl) sulfide, and bis(4-hydroxyphenyl) sulfide; dihydroxyaryl sulfoxide, such as bis(4-hydroxyphenyl) sulfoxide; dihydroxydiphenyls, such as 4,4'-dihydroxydiphenyl; dihydroxybenzenes, such as hydroquinone, resorcinol, and methylhydroquinone; and dihydroxynaphthalenes, such as 1,5-dihydroxynaphthalene and 2,6-dihydroxynaphthalene. These dihydric phenols may be used singly or in combination.

Further, examples of the carbonate ester compounds may include: diaryl carbonates, such as diphenyl carbonate; and dialkyl carbonates, such as dimethyl carbonate and diethyl carbonate.

The polycarbonate resin used in the present invention may be either a homopolymer obtained by using a single species of such dihydric phenols, or a copolymer obtained by using two or more species of such dihydric phenols, or a blend of such homopolymers and/or copolymers. It is also possible to use a thermoplastic random-branched polycarbonate resin obtained by reacting a polyfunctional aromatic compound having three or more functional groups with the above-mentioned dihydric phenol and/or carbonate precursor.

Further, in order to control the glass transition temperature and viscoelasticity of the polycarbonate resin, it is also possible to suitably use a modified polycarbonate resin in a form as obtained by replacing a portion of the dihydric phenol constituting the polycarbonate with a polyhydric alcohol having two or more hydroxyl groups, such as ethylene glycol, diethylene glycol, triethylene glycol, 1,2-propylene glycol, 1,3-propylene glycol, 1,4-butanediol, neopentyl glycol, 1,4-bis(hydroxymethyl)cyclohexane, 1,4-bis (2-hydroxyethyl)benzene, 1,4-cyclohexane-dimethanol, polyethylene glycol, propylene glycol, hydrogenated bisphenol A or its derivative, bisphenol A ethylene oxide-adduct, bisphenol A propylene oxide-adduct, glycerin, trimethylolpropane, or pentaerythritol. Such a modified polycarbonate resin may be produced through the above-described process by simply replacing a portion of the dihydric phenol. As an example of other process, a dihydric phenol and an aliphatic or aromatic bischloroformate may be reacted with each other in the presence of catalyst pyridine in a solvent of methylene chloride. Of course, other production processes may also be used.

As the polycarbonate resin, it is also possible to use a block copolymer of the above-mentioned polycarbonate with another polymer, such as polystyrene, styrene-(meth) acrylate copolymer, polyester, polyurethane, epoxy resin, polyolefin, polyamide, polysulfone, polycyanoaryl ether, or polyarylene sulfide, or a graft-modified copolymer obtained by graft-polymerizing a monomer, such as alkyl(meth) acrylate, (meth)acrylic acid, maleic acid or styrene monomer.

The polycarbonate resin used in the present invention may basically have any molecular weight but may preferably have a peak molecular weight (Mp) in the range of $10^3$–$5\times10^5$, more preferably $2\times10^3$–$10^5$. If the peak molecular weight is below 1000, the chargeability of the resultant toner can be adversely affected in some cases. In excess of $5\times10^5$, the molt-viscosity becomes excessive, and the fixability of the toner can be adversely affected in some cases. In producing the polycarbonate resin used in the present invention, it is possible to use an appropriate agent, such as a molecular weight adjusting agent, a branching agent for improving the visco-elasticity or a reaction promoting catalyst, as desired.

The polycarbonate resin may basically be used in any amount but may ordinarily be in 0.1–50 wt. parts, preferably 0.5–30 wt. parts; per 100 wt. parts of the total binder resin other than the polycarbonate resin. Below 0.1 wt. part, the addition effect cannot be sufficiently exhibited. In excess of 50 wt. parts, some difficulties may be encountered with respect to the chargeability, fixability and matching with image forming apparatus.

The colorants usable in the present invention may include a yellow colorant, a magenta colorant, a cyan colorant, as may be selected from the groups of colorants described below, and also a black colorant which may comprise carbon black, a magnetic material, or a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and acrylamide compounds. Specific preferred examples thereof may include C.I. Pigment Yellow 12, 13, 14, 15, 17, 62, 74, 83, 93, 94, 95, 109, 110, 111, 128, 129, 147, 168, and 180.

Examples of the magenta colorant may include: condensed azo compounds, diketopyrrolepyrrole compounds, anthraquinone compounds, quinacridone compounds, basic dye lake compounds, naphthol compounds, benzimidazole compounds, thioindigo compounds and perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basic dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, OHP transparency, and a dispersibility in toner particles. The above colorants may preferably be used in a proportion of 1–20 wt. parts per 100 wt. parts of the binder resin. A black colorant comprising a magnetic material, unlike the other colorants, may preferably be used in a proportion of 40–150 wt. parts per 100 wt. parts of the binder resin.

The toner according to the present invention can contain a charge control agent. The charge control agent may be a known one and may preferably be one having a higher charging speed and a property capable of stably retaining a prescribed charge amount. In the case of using the direct polymerization for producing the toner particles of the present invention, the charge control agent may particularly preferably be one free from polymerization-inhibiting properties and not containing a component soluble in an aqueous medium.

The charge control agent used in the present invention may be those of negative-type or positive-type. Specific examples of the negative charge control agent may include: metal-containing acid-based compounds comprising acids such as salicylic acid, alkylsalicylic acid, dialkylsalicylic acid, naphtoic acid, dicarboxylic acid and derivatives of these acids; polymeric compounds having a side chain comprising sulfonic acid or carboxylic acid; boron compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent used in the present invention may preferably be used in a proportion of 0.5–10 wt. parts per 100 wt. parts of the binder resin. However, the charge control agent is not an essential component for the toner particles used in the present invention. The charge control agent can be used as an optional additive in some cases. In the case of using two-component developing method, it is possible to utilize triboelectric charge with a carrier. In the case of using a non-magnetic one-component blade coating developing method, it is possible to omit a charge control agent by positively utilizing a triboelectric charge through friction with a blade member or a sleeve member.

It is preferred to externally add inorganic fine powder to the toner according to the present invention in order to improve the developing performance, tranferability, stable chargeability, flowability and continuous image forming performance. Known inorganic fine powders can be used for this purpose, but it is preferred to use one selected from silica, alumina, titania and complex oxides of these. It is further preferred to use silica. Silica used for this purpose may include dry-process silica or fumed silica produced by vapor-phase oxidation of silicon halide or alkoxide and wet-process silica produced from silicon alkoxide, water glass, etc. However, it is preferred to use dry-process silica with less silanol group at the surface or inside of the particles and with less production residues, such as $Na_2O$, $SO_3^{2-}$, etc. In the production process of dry-process silica, it is also possible to use another metal halide, such as aluminum chloride or titanium chloride together with silicon halide to obtain fine powder of a complex oxide of silica and another metal oxide, which may also be used as a species of silica, as a preferred inorganic fine powder in the present invention.

Such inorganic fine powder may exhibit good performance when it has a specific surface area as measured by nitrogen absorption according to the BET method, e.g. by using a specific surface meter (e.g., "AUTOSORB 1", available from Yuasa Ionix K.K.) for adsorption of nitrogen gas onto the sample surface according to the BET multi-point method. The inorganic fine powder may be added in 0.1–8 wt. parts, preferably 0.5–5 wt. parts, further preferably 1.0–5 wt. parts, further preferably 1.0–3.0 wt. parts, per 100 wt. parts of the toner.

For the purpose of hydrophobization, chargeability control, etc., as desired, the inorganic fine powder may preferably be treated with one or a plurality in combination of treating agents, such as silicone oil or silicone varnish, various modified silicone oils, silane coupling agents, silica coupling agent having a functional group, other organosilicon compounds, and organic titanium compounds. For retaining a high chargeability and and accomplishing lower consumption and high transferability of the toner, it is further preferred that the inorganic fine powder is treated with at least silicone oil.

Within an extent of not exerting substantially adverse effects, the toner can further contain other additives, examples of which may include: lubricating powders, such as powders of polytetrafluoroethylene, zinc stearate and polyvinylidene fluoride; abrasives, such as powders of cerium oxide, silicon carbide and strontium titanate; flowability-imparting agents, such as powders of titanium oxide and aluminum oxide; anti-caking agent, and electroconductivity-imparting agents, such as carbon black and powders of zinc oxide and tin oxide. It is also possible to add a small amount of organic and/or inorganic fine particles having a triboelectric chargeability opposite to that of the toner particles.

As a process for producing a toner according to the present invention, there may be adopted a pulverization process wherein the binder resin, the colorant, the wax (component) and other optional additives such as a charge control agent and other internal additives are uniformly kneaded and dispersed by a pressure kneader, an extruder or a media disperser, and the kneaded product is mechanically pulverized or caused to impinge onto a target in a jet stream to be pulverized into a desired toner particle size level, followed optionally by a step of smoothing and sphering the pulverized particles and then by classification into a narrower particle size distribution to form toner particles. In addition, it is also possible to adopt a process for obtaining spherical toner particles by spraying a molten mixture into air by using a disk or a multi-fluid nozzle as disclosed in JP-B 56-13945, etc.; a process for directly producing toner particles according to suspension polymerization as disclosed in JP-B 36-10231, JP-A 59-53856, and JP-A 59-61842; a dispersion polymerization process for directly producing toner particles in an aqueous organic solvent in which the monomer is soluble but the resultant polymer is insoluble; and a process for producing toner particles according to emulsion polymerization as represented by soap-free polymerization wherein toner particles are directly formed by polymerization in the presence of a water-soluble polymerization initiator.

According to the pulverization process for toner production, it is difficult to obtain toner particles having a circularity in the prescribed range. According to the melt-spraying process, the resultant toner particles are liable to have a broad particle size distribution even if they have a certain level of circularity, and it is difficult to provide toner particles with an adequately controlled surface state. On the other hand, the dispersion polymerization process provides toner particles having an extremely sharp particle size distribution but allows only a narrow latitude for selection of usable materials, and the use of an organic solvent requires a complicated production apparatus and troublesome operations accompanying the disposal of a waste solvent and inflammability of the solvent. The emulsion polymerization process as represented by the soap-free polymerization is effective for providing toner particles having a relatively narrow particle size distribution, but the used emulsifier and polymerization initiator terminal are liable to be present at the toner particle surfaces, thus resulting in an inferior environmental characteristic.

In the present invention, it is important to provide toner particles with a controlled circularity frequency distribution, and for this purpose, it is preferred to adopt the emulsion polymerization process or the suspension polymerization process, under the normal or elevated pressure, capable of relatively easily providing fine toner particles of 2–6 $\mu$m in number average circle-equivalent diameter. It is also possible to apply the preliminarily obtained polymerizate particles to a shape-adjusting treatment with media or by direct impingement onto a collision plate, or to coalescence of the polymerizate particles by freezing, salting-out or coagulation with particles having an opposite-polarity surface charge under a controlled pH in an aqueous medium. It is also possible to adopt a seed polymerization process wherein a monomer is further adsorbed onto once-obtained polymerizate particles and polymerized by using a polymerization initiator.

In the case of producing toner particles through a direct polymerization process wherein droplets of a polymerizable monomer composition are polymerized in an aqueous medium, it is possible to control the circularity distribution and particle size distribution of the resultant toner particles by changing the species and amount of a hardly water-soluble inorganic salt or a dispersing agent functioning as a protective colloid; by controlling the mechanical process conditions, including stirring conditions such as a rotor peripheral speed, a number of passes and a stirring blade shape, and a vessel shape; and/or by controlling a weight percentage of solid matter in the aqueous dispersion medium. Further, as mentioned hereinbefore, it is also possible to obtain prescribed toner particles by adjusting the stirring conditions and process time of a conical drying machine for drying toner particles.

In the toner production by direct polymerization, examples of the polymerization initiator may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while referring to their 10-hour half-life temperature.

In order to control the molecular weight of the resultant binder resin, it is also possible to add a crosslinking agent, a chain transfer agent, a polymerization inhibitor, etc.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles according to the present invention may be produced by direct polymerization in the following manner. Into a vinyl monomer, a colorant, a wax (component), and optionally a charge control agent, a polymerization initiator and another optional additive are added and uniformly dissolved or dispersed to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50–90° C. The temperature can be raised at a latter stage of the polymerization. It is also possible to subject a part of the aqueous system to distillation in a latter stage of or after the polymerization in order to remove the yet-unpolymerized part of the polymerizable monomer and a by-product which can cause and odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

An image forming method to which the toner according to the present invention is applicable will now be described with reference to the drawings.

Referring to FIG. 1, an image forming apparatus principally includes a photosensitive member 1 as an (electrostatic) image-bearing member, a charging roller 2 as a charging means, a developing device 4 comprising four developing units 4-1, 4-2, 4-3 and 4-4, an intermediate transfer member 5, a transfer roller 7 as a transfer means, and a fixing device H as a fixing means.

Four developers comprising cyan toner particles, magenta toner particles, yellow toner particles, and black toner particles are incorporated in the developing units 4-1 to 4-4. An electrostatic image is formed on the photosensitive member 1 and developed with the four color toner particles by a developing method such as a magnetic brush developing system or a non-magnetic monocomponent developing system, whereby the respective toner images are formed on the photosensitive member 1.

Figure 2:
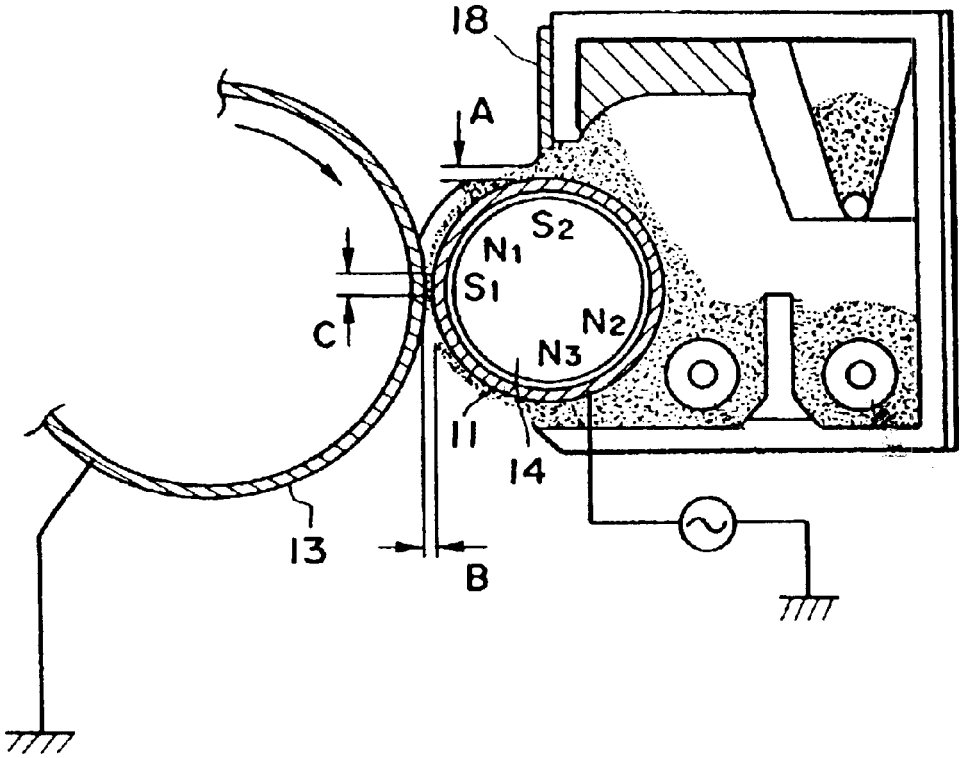
FIG. 2 is an enlarged sectional view of a developing apparatus using a two-component type developer used in an embodiment of the invention.

A non-magnetic toner according to the present invention may be blended with a magnetic carrier and may be used for development by using a developing means as shown in FIG. 2. It is preferred to effect a development in a state where a magnetic brush contacts a latent image-bearing member, e.g., a photosensitive drum 13 under application of an alternating electric field. A developer-carrying member (developing sleeve) 11, enclosing therein a magnet roller 14, may preferably be disposed to provide a gap B of 100–1000 $\mu$m from the photosensitive drum 13 in order to prevent the toner attachment and improve the dot reproducibility. If the gap is narrower than 100 $\mu$m, the supply of the developer is liable to be insufficient to result in a low image density. In excess of 1000 $\mu$m, the lines of magnetic force exerted by a developing pole S1 is spread to provide a low density of magnetic brush, thus being liable to result in an inferior dot reproducibility and a weak carrier constraint force leading to carrier attachment.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 11 with the photosensitive drum 13 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 18 and the developing sleeve 11 and/or changing the gap B between the developing sleeve 11 and the photosensitive drum 13.

In formation of a full color image for which a halftone reproducibility is a great concern may be performed by using at least 3 developing devices for magenta, cyan and yellow, adopting the toner according to the present invention and preferably adopting a developing system for developing digital latent images in combination, whereby a development faithful to a dot latent image becomes possible while avoiding an adverse effect of the magnetic brush and disturbance of the latent image. The use of the toner according to the present invention is also effective in realizing a high transfer ratio in a subsequent transfer step. As a result, it becomes possible to obtain high image qualities both at the halftone portion and the solid image portion.

In addition to the high image quality at an initial stage of image formation, the use of the toner according to the present invention is also effective in avoiding the lowering in image quality in a continuous image formation on a large number of sheets.

Figure 3:
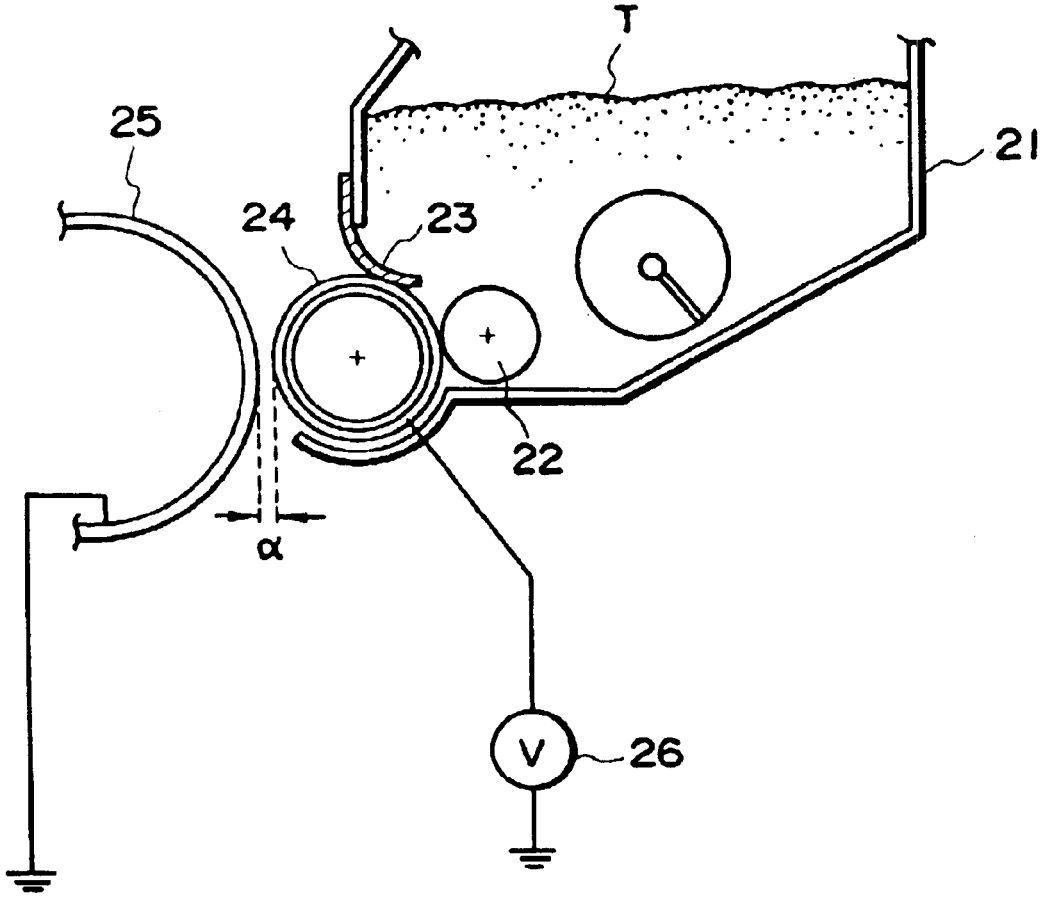
FIG. 3 is an enlarged sectional view of a developing apparatus using a mono-component type developer used in an embodiment of the invention.

The toner according to the present invention may also be realized as a toner for a mono-component development method. FIG. 3 illustrates an example for such a development apparatus.

Referring to FIG. 3, an electrostatic image formed on an electrostatic image-bearing member 25 by electrophotography or electrostatic recording may be developed with a toner T contained in a toner vessel 21 and applied on a non-magnetic developing sleeve (toner-carrying member) 24 comprising aluminum or stainless steel.

Almost a right half circumference of the developing sleeve is caused to always contact the toner T stored in the toner vessel 21, and the toner in proximity to the developing sleeve 24 is attached to and carried on the developing sleeve 24 under the action of a magnetic force generated by a magnetic field-generating means in the developing sleeve and/or an electrostatic force.

The toner carrying member 24 may have a surface roughness Ra set to 1.5 $\mu$m or smaller, preferably 1.0 $\mu$m or smaller, further preferably 0.5 $\mu$m or smaller.

By setting the surface roughness Ra to at most 1.5 $\mu$m, the toner particle-conveying force of the toner carrying member is suppressed to allow the formation of a thin toner layer on the toner-carrying member and increase the number of contents between the toner carrying member and the toner, to thereby improve the toner chargeability.

In case where the surface roughness Ra of the toner carrying member exceeds 1.5, it become difficult to form a thin layer of toner on the toner carrying member and improve the toner chargeability, so that the improvement in image quality becomes difficult to realize.

The surface roughness Ra of the toner carrying member refers to a center line-average roughness as measured by a surface roughness tester ("SURCODER SE-30H", available from K.K. Kosaka Kenkyusho) according to JIS B0601. More specifically, the surface roughness Ra may be determined by taking a measurement length a of 2.5 mm along a center line (taken on an x-axis) and taking a roughness on a y-axis direction to represent the roughness curve by a function of y=f(x) to calculate a surface roughness Ra ($\mu$m from the following equation:

$$Ra = (1/a)\int_0^a \left| f(x) \right| dx.$$

The toner-carrying member may preferably comprise a cylinder or a belt of stainless steel, aluminum, etc., which may be surface-coated with a metal, a resin, or a resin containing fine particles of a resin, a metal, carbon black or a charge control agent.

If the surface-moving velocity of the toner-carrying member is set to be 1.05–3.0 times the surface moving speed of the electrostatic image-bearing member, the toner layer on the toner-carrying member receives an appropriate degree of stirring effect to realize a better faithful reproduction of an electrostatic image.

If the surface speed of the toner carrying member is below 1.05 times that of the electrostatic image-bearing member, such a toner layer stirring effect is insufficient, so that it becomes difficult to expect a good image formation. Further, in the case of forming a solid image requiring a large amount of toner over a wide area, the toner supply to the electrostatic image is liable to be insufficient to result in a lower image density. On the other hand, in excess of 3.0, the toner is liable to be excessively charged and cause difficulties, such as toner deterioration or sticking onto the toner-carrying member (developing sleeve).

The toner T stored in the hopper (toner vessel) 21 is supplied to the developing sleeve 24 by means of a supply member 22. The supply member may preferably be in the form of a supply roller comprising a porous elastic material or a foam material, such as soft polyurethane foam. The supply roller 22 is rotated at a non-zero relative velocity in a forward or reverse direction with respect to the developing sleeve, whereby the peeling of the toner (a portion of the toner not used for development) from the developing sleeve simultaneously with the toner supply to the developing sleeve. In view of the balance between the toner supply and toner peeling, the supply roller 22 may preferably be abutted to the developing sleeve in a width of 2.0–10.0 mm, more preferably 4.0–6.0 mm. On the other hand, a large stress is liable to be applied to the toner to promote the toner deterioration or agglomeration or melt-sticking of the toner onto the developing sleeve and the supply roller, but, as the toner according to the present invention is excellent in flowability, releasability and durability, so that the toner is suitably used in the developing method using such a supply roller. The supply member can also comprise a brush member of resinous fiber of, e.g., nylon or rayon. The use of such a supply member is very effective for a non-magnetic monocomponent toner not capable of utilizing a magnetic constraint forth for toner application but can also be applicable to a monocomponent development method using a magnetic monocomponent method.

The toner supplied to the developing sleeve can be applied uniformly in a thin layer by a regulation member. The thin toner layer-regulating member may comprise a doctor blade, such as a metal blade or a magnetic blade, disposed with a certain gap from the developing sleeve, or alternatively may comprise a rigid roller or a sleeve of a metal, a resin or a ceramic material, optionally including therein a magnetic field generating means.

Alternatively, it is also possible to constitute such a thin toner layer-regulating member as an elastic member, such as an elastic blade or an elastic roller, for applying a toner under pressure. FIG. 3, for example, shows an elastic blade 23 fixed at its upper but root portion to the developer vessel 21 and having its lower free length portion pressed at an appropriate pressure against the developing sleeve so as to extend in a reverse direction (as shown or in a forward direction). By using such an application means, it becomes possible to form a tight toner layer stable against an environmental change. The mechanism thereof has not been fully clarified as yet, but it is assumed that the forcible triboelectrification with the developing sleeve surface due to the elastic member allows a constant state charging regardless of a change in toner behavior accompanying an environmental change.

On the other hand, the use of such an elastic blade is liable to cause an excessive charge and a toner melt-sticking onto the developing sleeve or the elastic blade, but the toner of the present invention is suitably used because of excellent releasability and stable triboelectric chargeability.

The elastic material may preferably comprise a material having an appropriate chargeability position in a triboelectric chargeability series so as to charge the toner to an appropriate polarity and may for example comprise: an elastomer, such as silicone rubber, urethane rubber or NBR; an elastic synthetic resin, such as polyethylene terephthalate; an elastic metal, such as stainless steel, steel and phosphor bronze; or a composite material of these.

In the case of providing a durable elastic member, it is preferred to use a laminate of an elastic metal and a resin or rubber or use a coated member.

Further, the elastic material can contain an organic material or an inorganic material added thereto, e.g., by melt-mixing or dispersion. For example, by adding a metal oxide, a metal powder, a ceramic, carbon allotrope, whisker, inorganic fiber, dye, pigment or a surfactant, the toner chargeability can be controlled. Particularly, in the case of using an elastic member formed of a rubber or a resin, it is preferred to add fine powder of a metal oxide, such as silica, alumina, titania, tin oxide, zirconia oxide or zinc oxide; carbon black; or a charge control agent generally used in toners.

Further, by applying a DC and/or AC electric field to the blade regulation member, or the supply roller or brush member, it becomes possible to exert a disintegration action onto the toner layer, particularly enhance the uniform thin layer application performance and uniform chargeability at the regulating position, and the toner supply/peeling position at the supply position, thereby providing increased image density and better image quality.

The elastic member may be abutted against the toner-carrying member at an abutting pressure of at least 0.1 kg/m, preferably 0.3–25 kg/m, further preferably 0.5–12 kg/m, in terms of a linear pressure in the direction of a generatrix of the toner-carrying member. As a result, it becomes possible to effectively disintegrate the toner to realize a quick charging of the toner. If the abutting pressure is below 0.1 kg/m, the uniform toner application becomes difficult to result in a broad toner charge distribution leading to fog and scattering. Above 25 kg/m, an excessive pressure is applied to the toner to cause toner deterioration or toner agglomeration, and a large torque becomes necessary for driving the toner-carrying member.

It is preferred to dispose the electrostatic image-bearing member 25 and the toner-carrying member 24 with a gap $\alpha$ of 50–500 $\mu$m, and a doctor blade may disposed with a gap of 50–400 $\mu$m from the toner-carrying member.

It is generally most preferred that the toner layer thickness is set to be thinner than the gap between the electrostatic image-bearing member and the toner carrying member, but the toner layer thickness can be set so that a portion of toner ears constituting the toner layer contacts the electrostatic image-bearing member.

Further, by forming an alternating electric field between the electrostatic image-bearing member and the toner-carrying member from a bias voltage supply 26, it becomes possible to facilitate the toner movement from the toner-carrying member to the electrostatic image-bearing member, thereby providing a better quality of images. The alternating electric field may comprise a peak-to-peak voltage Vpp of at least 100 volts, preferably 200–3000 volts, further preferably 300–2000 volts, and a frequency f of 500–5000 Hz, preferably 1000–3000 Hz, further preferably 1500–3000 Hz. The alternating electric field may comprise a waveform of a rectangular wave, a sinusoidal wave, a sawteeth wave or a triangular wave. Further, it is also possible to apply an asymmetrical AC bias electric field having a positive wave portion and a negative wave portion having different voltages and durations. It is also preferred to superpose a DC bias component.

Referring again to FIG. 1, the electrostatic image-bearing member 1 may comprise a photosensitive drum (or a photosensitive belt) comprising a layer of a photoconductive insulating material, such as a-Se, CdS, $ZnO_2$, OPC (organic photoconductor), and a-Si (amorphous silicon). The electrostatic image-bearing member 1 may preferably comprise an a-Si photosensitive layer or OPC photosensitive layer.

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

A charging step may be performed by using a corona charger which is not in contact with the photosensitive member 1 or by using a contact charger, such as a charging roller. The contact charging system as shown in FIG. 1 may preferably be used in view of efficiency of uniform charging, simplicity and a lower ozone-generating characteristic.

The charging roller 2 comprises a core metal 2*b* and an electroconductive elastic layer 2*a* surrounding a periphery of the core metal 2*b*. The charging roller 2 is pressed against the photosensitive member 1 at a prescribed pressure (pressing force) and rotated mating with the rotation of the photosensitive member 1.

The charging step using the charging roller may preferably be performed under process conditions including an applied pressure of the roller of 5–500 g/cm, an AC voltage of 0.5–5 kVpp, an AC frequency of 50–5 kHz and a DC voltage of ±0.2–±1.5 kV in the case of applying AC voltage and DC voltage in superposition; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

The toner image formed on the electrostatic image-bearing member 1 is transferred to an intermediate transfer members 5 to which a voltage (e.g., ±0.1–±5 kV) is applied. The surface of the electrostatic image-bearing member may then be cleaned by cleaning means 9 including a cleaning blade 8.

The intermediate transfer member 5 comprises a pipe-like electroconductive core metal 5*b* and a medium resistance-elastic layer 5*a* (e.g., an elastic roller) surrounding a periphery of the core metal 5*b*. The core metal 5*b* can comprise a plastic pipe coated by electroconductive plating. The medium resistance-elastic layer 5*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm. The intermediate transfer member 5 is disposed under the electrostatic image-bearing member 1 so that it has an axis (or a shaft) disposed in parallel with that of the electrostatic image-bearing member 1 and is in contact with the electrostatic image-bearing member 1. The intermediate transfer member 5 is rotated in the direction of an arrow (counterclockwise direction) at a peripheral speed identical to that of the electrostatic image-bearing member 1.

The respective color toner images are successively intermediately transferred to the peripheral surface of the intermediate transfer member 5 by an elastic field formed by applying a transfer bias to a transfer nip region between the electrostatic image-bearing member 1 and the intermediate transfer member 5 at the time of passing through the transfer nip region.

After the intermediate transfer of the respective toner image, the surface of the intermediate transfer member 5 is cleaned, as desired, by a cleaning means 10 which can be attached to or detached from the image forming apparatus. In case where the toner image is placed on the intermediate transfer member 5, the cleaning means 10 is detached or released from the surface of the intermediate transfer member 5 so as not to disturb the toner image.

The transfer means (e.g., a transfer roller) 7 is disposed under the intermediate transfer member 5 so that it has an axis (or a shaft) disposed in parallel with that of the intermediate transfer member 5 and is in contact with the intermediate transfer member 5. The transfer means (roller) 7 is rotated in the direction of an arrow (clockwise direction) at a peripheral speed identical to that of the intermediate transfer member 5. The transfer roller 7 may be disposed so that it is directly in contact with the intermediate transfer member 5 or in contact with the intermediate transfer member 5 via a belt, etc. The transfer roller 7 may comprise an electroconductive elastic layer 7*a* disposed on a peripheral surface of a core metal 7*b*.

The intermediate transfer member 5 and the transfer roller 7 may comprise known materials as generally used. By setting the volume resistivity of the elastic layer 5*a* of the intermediate transfer member 5 to be higher than that of the elastic layer 7*b* of the transfer roller, it is possible to alleviate a voltage applied to the transfer roller 7. As a result, a good toner image is formed on the transfer-receiving material and the transfer-receiving material is prevented from winding about the intermediate transfer member 5. The elastic layer 5*a* of the intermediate transfer member 5 may preferably have a volume resistivity at least ten times that of the elastic layer 7*b* of the transfer roller 7.

The transfer roller 7 may comprise a core metal 7*b* and an electroconductive elastic layer 7*a* comprising an elastic material having a volume resistivity of $10^6$–$10^{10}$ ohm.cm, such as polyurethane or ethylene-propylene-diene terpolymer (EPDM) containing an electroconductive substance, such as carbon, dispersed therein. A certain bias voltage (e.g., preferably of ±0.2–±10 kV) is applied to the core metal 7*b* by a constant-voltage supply.

The toner according to the present invention exhibits a high transfer efficiency in the transfer steps to leave little transfer residual toner and also exhibits excellent cleanability, so that it does not readily cause filming on the electrostatic image-bearing member. Further, even when subjected to a continuous image formation test on a large number of sheets, the toner according to the present invention allows little embedding of the external additive at the toner particle surface, so that it can provide a good image quality for a long period. Particularly, the toner according to the present invention can be suitably used in an image forming apparatus equipped with a re-use mechanism wherein the transfer residual toner on the electrostatic image-bearing member and the intermediate transfer member is recovered and re-used for image formation.

Figure 11:
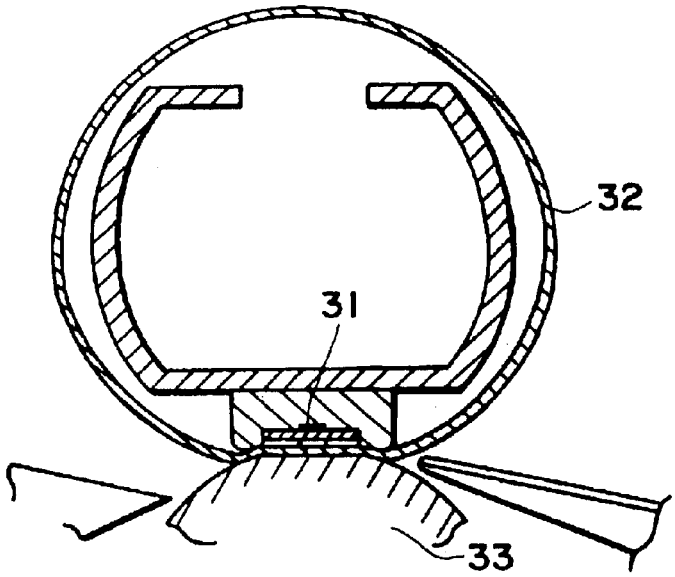
FIG. 11 is an enlarged sectional view of the fixing apparatus including a film in a non-driven state.

The transfer-receiving material 6 carrying the transferred toner image is then conveyed to heat-pressure fixation means, inclusive of a hot roller fixation device comprising basically a heating roller enclosing a heat-generating member, such as a halogen heater, and a pressure roller comprising an elastic material pressed against the heating roller, and a hot fixation device for fixation by heating via a film (as shown in FIGS. 10 and 11, wherein reference numeral 31 denotes a heating member including a temperature-detecting element; 32, a fixing film disposed in a tension-free state; and 33, a pressing roller. As the toner according to the present invention has excellent fixability and anti-offset characteristic, the toner is suitably used in combination with such a heat-pressure fixation device.

EXAMPLE

Hereinbelow, the present invention will be described more specifically based on Examples and Comparative Examples.

In the following Examples and Comparative Examples, waxes <A> to <D> and <a> respectively obtained by fractionation of polyalkylenes synthesized through the Fischer Tropsch process. DSC measurement data and molecular weight data of those waxes are summarized in the following Table 2.

TABLE 2

DSC data and molecular weight of waxes

| | DSC data | | | Weight average |
|---|---|---|---|---|
| | Heat-absorption peak | | | molecular |
| Wax | maximum peak temp. MP (° C.) | Onset temp. SP (° C.) | MP-SP (° C.) | weight (Mw) |
| <A> | 76 | 51 | 25 | 1050 |
| <B> | 64 | 55 | 9 | 890 |
| <C> | 97 | 64 | 33 | 1590 |
| <D> | 52 | 42 | 10 | 670 |
| <a> | 107 | 54 | 53 | 2260 |

Toner Production Examples and Comparative Production Examples

Toner Production Example 1

Into a 2-liter four-necked separable flask equipped with a high-speed stirrer ("TK HOMOMIXER", available from Tokushu Kika Kogyo), 650 wt. parts of de-ionized water and 500 wt. parts of 0.1 mol/liter-$Na_3PO_4$ aqueous solution were charged, stirred at 12,000 rpm and held under warming at 70° C. Into the system, 70 wt. parts of 0.1 mol/liter-$CaCl_2$ aqueous solution was gradually added to prepare an aqueous dispersion medium containing finely dispersed hardly water-soluble dispersion stabilizer $Ca_3(PO_4)_2$.

On the other hand, as a material to be dispersed, a polymerizable monomer composition was prepared in the following manner. That is, the following ingredients:

| | |
|---|---|
| Styrene | 77 wt. part(s) |
| 2-Ethylhexyl acrylate | 23 wt. part(s) |
| Divinylbenzene | 0.2 wt. part(s) |
| Carbon black | 8 wt. part(s) |
| 1,1-Bis(4-hydroxyphenyl)-cyclohexane polycarbonate (peak molecular weight (Mp) = 6500, Mw = 7500, Mn = 2800) | 6 wt. part(s) |
| Negative charge control agent (azo dye iron compound) | 2 wt. part(s) |
| Wax <A> in Table 2 | 10 wt. part(s) |

were subjected to 3 hours of dispersion by an attritor (available from Mitsui Kinzoku Kako K.K.). Then, 5 wt. parts of 2,2'-azobis(2,4-dimethylveleronitrile) was added thereto to prepare a polymerizable monomer composition.

The thus-formed polymerizable monomer composition was then added to the above-prepared aqueous dispersion medium, and the system was subjected to 15 min. of high-speed stirring at 12000 rpm by the high-speed stirrer at 70° C. in a nitrogen atmosphere to form dispersion droplets of the polymerizable monomer composition. Thereafter, the high-speed stirrer was replaced by propeller stirring blades, and the system was held at 70° C. for 10 hours under stirring at 50 rpm, to complete the polymerization.

After the polymerization, the residual monomer was distilled off at 80° C. under a reduced pressure of 47 kPa (350 Torr), followed by cooling of the suspension liquid and addition of dilute hydrochloric acid to remove the dispersion stabilizer. The resultant polymerizate particles were washed several times with water and then charged in a conical blender-type drier equipped with a helical ribbon stirring blade (available from Ohkawara Seisakusho K.K.), wherein the polymerizate particles were subjected to 6 hours of sphering and drying under stirring of the helical ribbon stirrer and heating at 45° C. and a reduced pressure of 1.3 kPa (10 Torr) to obtain Polymerizate particles (A), which exhibited a number-average circle-equivalent diameter ($\overline{d}_1$ or $d_{1av.}$) of 3.7 μm, a standard deviation of circle-equivalent diameter (SDd) of 1.5, an average circularity ($\overline{C}$ or $\phi_{av.}$) of 0.990, a standard deviation of circularity ($SD_c$ or $SD_\phi$) of 0.1, and GPC data including a peak molecular weight (Mp) of $1.3\times10^4$ and an Mw/Mn ratio of 12.

100 wt. parts of the thus treated Polymerizate particles (A) and 2 wt. Parts of hydrophobic oil-treated silica fine powder (BET) specific surface area ($S_{BET}$)=200 $m^2/g$) were dry-blended by means of a HENSCHEL mixer to obtain Toner (A) according to the present invention, which exhibited identical values of $d_{1av.}$, $SD_d$, $\phi_{av.}$ and $SD_\phi$ as those of Polymerizate particles (A) as a result of an FPIA measurement performed again. Toner (A) also exhibited a residual monomer content (Mres.) of 29 ppm and provided a TEM photograph showing a dispersion in a discrete state or an island-form of spherical wax particle as schematically shown in FIG. 5A.

5 wt. parts of Toner(A) was blended with 95 wt. parts of resin-coated magnetic ferrite carrier (average particle size (Dav)=40 μm) to prepare Developer (A) of two component-type for magnetic brush development.

Toner Production Examples 2–6

Polymerizate particles (B)–(F) were prepared in the same manner as in Toner Production Example 1 except for changing the species and amounts of wax and the species and amounts of polar resins as shown in Table 3, changing the conditions (temperature, reduced pressure level and process time) of the residual monomer distillation and changing the conditions (temperature, stirring condition and process time) of the treatment by the conical blender-type drier so as to control the particle size distribution, circularity and residual monomer content of the resultant toner particles (polymerizate particles). From the thus prepared Polymerizate particles (B)–(F), Toners (B)–(F) according to the present invention and Developers (B)–(F) were respectively prepared in the same manner as in Example 1.

Incidentally, the polar resins used in production of Toners (B)–(D) were the same species as the one used for preparation of Toner (A) in Example 1, and the polar resin used in production of Toner (F) was a polyester resin (Mp=5000, Mw=6000, Mn=1700) formed by polycondensation between propoxidized bisphenol A and terephthalic acid.

Toner Comparative Production Example 1

Comparative Polymerizate particles (a) were prepared in the same manner as in Toner Production Example 1 except for replacing Wax <A> and the polycarbonate resin respectively with Wax (D) and a saturated polyester resin (Mp=7000, formed by polycondensation between propoxidized bisphenol A and terephthalic acid) and by performing the sphering and drying treatment in the drier at 40° C. and 2.6 kPa (20 Torr). From Comparative Polymerizate particles (a), Comparative Toner (a) and further Comparative Developer (a) were prepared in the same manner as in Toner Production Example 1.

Toner Comparative Production Example 2

| | |
|---|---|
| Styrene-2-ethylhexyl acrylate divinylbenzene copolymer (Mp = $1.3 \times 10^4$, Mw/Mn = 2.2, Tg = 50° C.) | 100 wt. part(s) |
| Saturated polyester resin (Same as in Toner Comparative Production Example 1) | 6 wt. part(s) |
| Carbon black (Same as in Toner Production Example 1) | 8 wt. part(s) |
| Negative charge control agent (Same as in Toner Production Example 1) | 2 wt. part(s) |
| Wax <a> (shown in Table 2) | 10 wt. part(s) |

The above ingredients were melt-kneaded through a twin-screw extruder, and the kneaded product after cooling was coarsely crushed by a hammer mill and finely pulverized by a jet mill. The resultant pulverizate was sprayed into hot air to effect a sphering by heating. The thus-sphered pulverizate was classified to recover Classified powder (b), which was used in place of Polymerizate particles (A) to prepare Comparative Toner (b) and further Comparative Developer (b), otherwise in the same manner as in Toner Production Example 1.

Comparative Toner (b) exhibited a residual monomer content ($M_{res.}$) to 188 ppm, and in each toner particle thereof, the wax was present in a finely dispersed state.

Toner Comparative Production Example 3

Comparative Polymerizate particles (c) were prepared in the same manner as in Toner Production Example 1 except for replacing Wax <A> and the polycarbonate resin respectively with Wax (D) and a saturated polyester resin (Mp=6600, Tg=60° C.) and by performing the sphering and drying treatment in the drier at 50° C. and 1.3 kPa (10 Torr) for 3.5 hours. From Comparative Polymerizate particles (c), Comparative Toner (c) and further Comparative Developer (c) were prepared in the same manner as in Toner Production Example 1.

Comparative Toner (c) exhibited GPC data including Mp=$1.4\times10^4$ and Mw/Mn=14, a residual monomer content of 485 ppm, and the wax wax present i a finely dispersed state in the toner particles.

Various properties (including number-average circle-equivalent diameter ($\overline{d_1}$), standard deviation of circle-equivalent diameter ($SD_d$), average circularity ($\phi_{av.}$), standard deviation of circularity $SD_\phi$, residual monomer content ($M_{res.}$) and wax dispersion state in term of a ratio r/R between wax particle diameter (r) and toner particle diameter (R) of the above prepared Toners (A)–(F) and Comparative Toners (a)–(c) were measured in the manners described hereinbefore and inclusively shown in the following Table 3.

formed was transferred to an intermediate transfer member 5 (comprising an elastic layer 5*a* and a core metal 5*b* as a support) to form thereon a black color image. Residual toner particles on the photosensitive member 1 after the transfer were recovered by a cleaning member 8 to be contained in a residual toner container 9.

The intermediate transfer member 5 was formed by applying a coating liquid for the elastic layer 5*a* comprising carbon black (as an electroconductivity-imparting material) sufficiently dispersed in acrylonitrile-butadiene rubber (NBR) onto a pipe-like core metal 5*b*. The elastic layer 5*a* of the intermediate transfer member 105 showed a hardness of 30 degrees as measured by JIS K-6301 and a volume resistivity (Rv) of $10^9$ ohm.cm. The transfer from the photosensitive member 1 to the intermediate transfer member 5 was performed by applying a voltage of +500 V from a power supply to the core metal 5*b* to provide a necessary transfer current of about 4 $\mu$A.

The transfer roller 7 had a diameter of 18 mm and was formed by applying a coating liquid for the elastic layer 7*a* comprising carbon (as an electroconductivity-imparting material) sufficiently dispersed in a foamed ethylene-propylene-diene terpolymer (EPDM) onto a 9 mm dia.-core

TABLE 3

| | Wax | | Polar resin | | | C.E.D. *1 | | Circularity | | Residual | Wax | |
|---|---|---|---|---|---|---|---|---|---|---|---|---|
| Toner | species | amt. (wt. parts) | species *2 | amt. (wt. parts) | Peak M.W. (Mp) | $\overline{d_1}$ | $SD_d$ | $\phi_{av.}$ | $SD_\phi$ | monomer (ppm) | dispersion (r/R) | Anti-blocking |
| (A) | <A> | 10 | PC | 6 | 6500 | 3.7 | 1.5 | 0.990 | 0.016 | 29 | 0.52 | A |
| (B) | <B> | 18 | PC | 25 | 2200 | 3.9 | 1.6 | 0.981 | 0.021 | 45 | 0.67 | A |
| (C) | <B> | 5 | PC | 11 | 13000 | 5.8 | 1.9 | 0.993 | 0.013 | 191 | 0.31 | A |
| (D) | <C> | 25 | PC | 47 | 4000 | 4.6 | 1.7 | 0.972 | 0.028 | 436 | 0.93 | B |
| (E) | <D> | 3 | PC | 0.1 | $46\times10^4$ | 2.2 | 1.3 | 0.988 | 0.019 | 142 | 0.12 | B |
| (F) | <B> | 15 | PES | 10 | 5000 | 3.5 | 2.3 | 0.971 | 0.029 | 48.3 | 0.15 | C |
| Comp. | | | | | | | | | | | | |
| (a) | <D> | 10 | PES | 6 | 7000 | 5.1 | 2.7 | 0.962 | 0.032 | 725 | 0.15 | C |
| (b) | <a> | 10 | PES | 6 | 7000 | 5.8 | 3.6 | 0.997 | 0.011 | 188 | 0.01 | D |
| (c) | <D> | 22 | PES | 6 | 6600 | 3.8 | 2.0 | 0.980 | 0.039 | 485 | 0.17 | C |

*1: C.E.D. = circle-equivalent diameter.
*2: PC = polycarbonate, PES = polyester.

Examples 1–5 and Comparative Examples 1–2

Each of Developers (A)–(E) and Comparative Developers (a) and (b) prepared in the above-described production examples was charged in a black developing unit 4-4 (having a detailed structure as shown in FIG. 2) in a full-color image forming apparatus as shown in FIG. 1 and subjected to a black single color-mode image forming test. First of all, the outline of the image forming apparatus is explained.

Referring to FIG. 1, a photosensitive member 1 comprising a support 1*a* and a photosensitive layer 1*b* disposed thereon containing an organic photosemiconductor was rotated in the direction of an arrow and charged so as to have a surface potential of −600 V by a charging roller 2 (comprising an electroconductive elastic layer 2*a* and a core metal 2*b*). An electrostatic image having a light (exposed) part potential of −100 V and a dark part potential of −600 V was formed on the photosensitive member 1 by exposing the photosensitive member 1 to light-image by using an image exposure means effecting ON and OFF based on digital image information through a polygonal mirror. The electrostatic image was developed with black toner particles contained in a developing unit 4-4 according to the reversal development mode to form a black toner image on the photosensitive member 1. The black color toner image thus metal 7*b*. The elastic layer 7*a* of the transfer roller 7 showed a hardness of 33 degrees as measured by JIS K-6301 and a volume resistivity of $10^6$ ohm.cm. The transfer from the intermediate transfer member 5 to a transfer-receiving material 6 was performed by applying a voltage to the transfer roller 7 to provide a transfer current of 15 $\mu$A.

The heat-fixing device H was a hot roller-type fixing device having no oil applicator system. The upper roller and lower roller were both surfaced with a fluorine-containing resin and had a diameter of 55 mm. The fixing temperature was 155° C. and the nip width was set to 8 mm.

Under the above-set conditions, each of the above-prepared Developers (A)–(E) and Comparative Developers (a) and (b) charged in the developing apparatus of FIG. 2 was evaluated by a single-color mode continuous printing test (i.e., by a toner consumption promotion mode without pose of the developing device) on 3000 sheets while replenishing the corresponding black toner as required at a print-out speed of 25 A4-size sheets/min. in an environment of normal temperature/normal humidity (N.T./N.H. =25° C./60% RH) or low temperature/low humidity (L.T./L.H. =15° C./10% RH), whereby the printed-out image quality was evaluated.

Each developer was also evaluated with respect to matching with the image forming apparatus used.

Residual toner recovered by cleaning was conveyed to and re-used in the developing device by means of a re-use mechanism.

The evaluation results are inclusively shown in Table 4 below. The evaluation standards are inclusively described at the end of the specification.

TABLE 4

| Evaluation of print-out image and matching with image forming apparatus | | | | | | | | | | | | | |
|---|---|---|---|---|---|---|---|---|---|---|---|---|---|
| | | Print-out image | | | | | | | | | | | |
| | | | | | 15° C./10% RH | | | | | | Matching with | | |
| | | 25° C./60% RH | | | | | | Scatter on paper of | | | | | *6 |
| Ex. & Comp. Ex. | Developer | *1 I.D. | *2 D.U | Fog | *1 I.D. | *3 Dot | Fog | 75 g/m$^2$ | 105 g/m$^2$ | 135 g/m$^2$ | *4 Drum | *5 I.T.M | Fix. device |
| Ex. 1 | (A) | A | A | A | A | A | A | A | A | A | A | A | A |
| Ex. 2 | (B) | A | A | A | A | A | A | A | A | A | A | A | A |
| Ex. 3 | (C) | A | B | B | A | B | B | A | A | B | B | C | C |
| Ex. 4 | (D) | A | B | A | A | B | A | A | B | C | B | A | B |
| Ex. 5 | (E) | B | B | B | B | A | C | A | A | B | C | B | B |
| Comp. Ex.1 | Comp. (a) | C | C | C | C | D | C | C | C | C | C | C | D |
| Comp. Ex. 2 | Comp. (b) | C | D | D | C | D | D | D | D | D | C | D | D |

*1: image density,
*2: density uniformity
*3: dot-reproducibility
*4: photosensitive drum
*5: intermediate transfer member
*6: fixing device

Examples 6 and 7 and Comparative Example 3

The developing device of the image forming apparatus shown in FIG. 2 and used in Example 1, etc. was replaced by one illustrated in FIG. 3, and each of Toner (B), Toner (F) and Comparative Toner (a) was subjected to an image forming test at a rate of 24 A4-size longitudinal sheets/min. according to an intermittent mode wherein a pause of 10 sec. was inserted between successive image formation cycles so as to promote the deterioration of the toner due to a preliminary operation accompanying re-start-up of the developing device, while setting the peripheral moving speed of the toner carrying member to 2.8 times that of the electrostatic image-bearing member and successively replenishing the toner as required. The evaluation was performed similarly as in Example 1, etc.

The toner-carrying member used had a surface roughness Ra of 1.5, the toner regulating blade was one obtained applying a urethane rubber sheet onto a phosphor bronze base sheet and further coating it with nylon to provide an abutting surface. The fixing device H was replaced by one illustrated in FIGS. 10 and 11 including a heating member for heating the toner image via a heat-resistant film. The heating member 31 was set to have a surface temperature of 130° C. as measured by its temperature-detecting element, and the heating member 31 was abutted against the sponge pressure roller 33 at a total pressure of 8 kg so as to provide a nip of 6 mm between the sponge pressure roller 33 and the fixing film 32. The fixing film 32 comprised a 60 $\mu$m-thick heat-resistant polyimide film coated With a low-resistivity release layer comprising polytetrafluoroethylene (of high molecular weight-type) with an electroconductive substance therein on its surface contacting a transfer paper.

The results of evaluation are shown in Table 5.

TABLE 5

| Evaluation of print-out image and matching with image forming apparatus | | | | | | | | | | | |
|---|---|---|---|---|---|---|---|---|---|---|---|
| | | Print-out image | | | | | | | | | |
| | | | | | 15° C./10% RH | | | | | | |
| | | | | | | | | Hollow image | | Matching with | |
| | | 25° C./60% RH | | | | | | on paper of | | | *6 |
| Ex. & Comp. Ex. | Developer | *1 I.D. | *2 D.U | Fog | *1 I.D. | *3 Dot | Fog | 128 g/m$^2$ | 135 g/m$^2$ | *7 Sleeve | Fix. device |
| Ex. 6 | (B) | A | A | A | A | A | A | A | A | A | B |
| Ex. 7 | (F) | B | B | B | B | C | B | B | B | B | B |

TABLE 5-continued

| Evaluation of print-out image and matching with image forming apparatus | | | | | | | | | | | |
|---|---|---|---|---|---|---|---|---|---|---|---|
| | | Print-out image | | | | | | | | | |
| | | | | | 15° C./10% RH | | | | | | |
| | | | | | | | | Hollow image | | Matching with | |
| | | 25° C./60% RH | | | | | | on paper of | | | *6 |
| Ex. & Comp. Ex. | Developer | *1 I.D. | *2 D.U | Fog | *1 I.D. | *3 Dot | Fog | 128 g/m$^2$ | 135 g/m$^2$ | *7 Sleeve | Fix. device |
| Comp. Ex. 3 | Comp. (a) | C | C | C | C | D | D | D | D | C | D |

*1: image density,
*2: density uniformity
*3: dot-reproducibility
*6: fixing device
*7: Developing sleeve Example 8 and Comparative Examples 4 and 5

Figure 4:
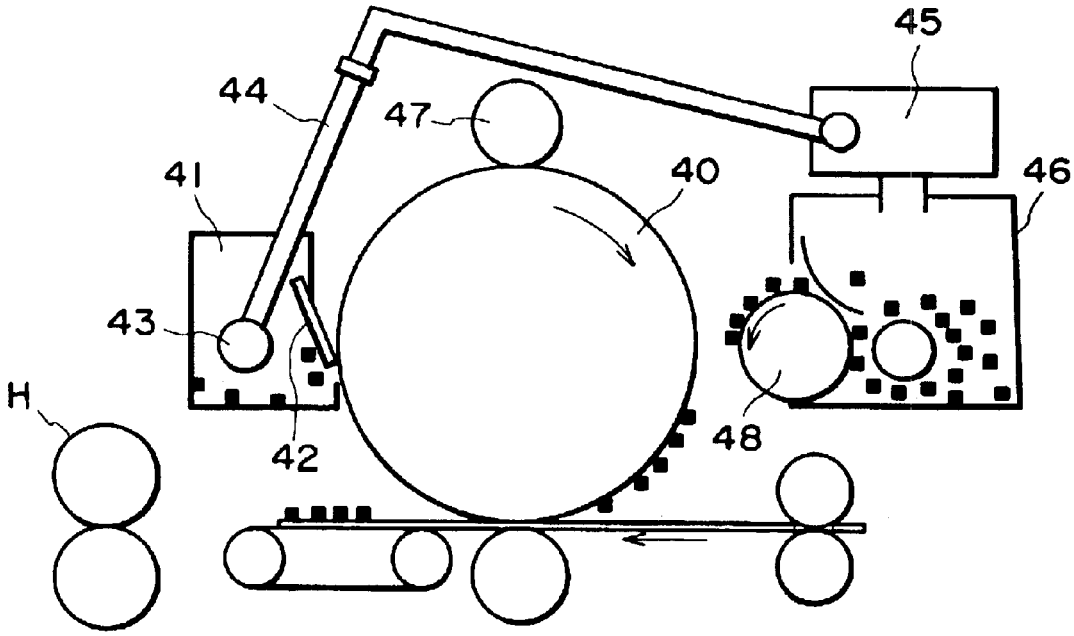
FIG. 4 is a schematic illustration of an image forming apparatus wherein a non-transferred portion of the toner is re-used.

A commercially available laser beam printer ("LBP-EX", available from Canon K.K.) was used for testing after being remodeled by attaching a re-use mechanism. More specifically, the printer was provided with a system as shown in FIG. 4, wherein a residual (non-transferred) toner on a photosensitive drum 40 was scraped off by an elastic blade 42 abutted to the photosensitive drum of a cleaner 41 and fed to an inside of the cleaner 41, and was further recycled to a developing apparatus 46 via a cleaner screw 43, a supplying pipe 44 equipped with a conveying screw and a hopper 45, for reuse of the recycled toner. For image formation, the photosensitive drum 40 was primarily charged by a primary charger roller 47 comprising a rubber roller containing electroconductive carbon dispersed therein, coated with nylon resin and having a diameter of 12 mm abutted against the photosensitive drum 40 at a pressure of 50 g/cm. The photosensitive drum 40 was further subjected to laser beam exposure at 600 dpi to form an electrostatic image with a dark-part potential $V_D$=−700 volts and a light-part potential $V_L$=−200 volts. The electrostatic image was developed with a toner carried on a toner-carrying member in the form of a developing sleeve 48 coated with a carbon black-dispersed resin layer and having a surface roughness Ra=1.1. The developing sleeve 48 was equipped with a urethane rubber blade as a toner regulating member and rotated at a peripheral speed which was 1.1 times that of the photosensitive drum 40. The sleeve 48 was spaced from the photosensitive drum 40 at a gap of 270 $\mu$m, across which an AC-superposed DC voltage was applied as a developing bias voltage. The hot fixing apparatus H was operated at a set temperature of 150° C.

Under the above-set conditions, each of Toner (A) and Comparative Toners (b) and (c) was subjected to an image forming test on 3000 sheets, while replenishing the toner as required according to an intermittent mode wherein a pause of 10 sec was inserted between successive image formation cycles so as to promote the deterioration of the toner due to a preliminary operation accompanying re-start-up of the developing device, at a print-out speed of 24 A4-size longitudinal sheets/min in environments of normal temperature/normal humidity (25° C./60% RH) and high temperature/high-humidity 30° C./80% RH). Each toner was evaluated with respect to items shown in Table 6 and the results of evaluation are summarized in Table 6.

TABLE 6

| Evaluation of print-out image and matching with image forming apparatus | | | | | | | | | | | | |
|---|---|---|---|---|---|---|---|---|---|---|---|---|
| | | Print-out image | | | | | | | | | | |
| | | | | | 30° C./80% RH | | | | | | | |
| | | 25° C./60% RH | | | | | | Scatter on paper of | | | Matching with | |
| Ex. & Comp. Ex. | Developer | *1 I.D. | *2 D.U | Fog | I.D. | *3 Dot | Fog | 75 g/m$^2$ | 105 g/m$^2$ | 135 g/m$^2$ | *4 Drum | *7 Sleeve |
| Ex. 8 | (A) | A | A | A | A | A | A | A | A | A | A | A |
| Comp. Ex.4 | Comp. (b) | C | D | C | C | D | D | C | D | D | D | D |
| Comp. Ex. 5 | Comp. (c) | C | C | C | C | C | D | C | C | D | C | D |

*1: image density,
*2: density uniformity
*3: dot-reproducibility
*4: photosensitive drum
*7: developing sleeve Example 9

Toner (A) was subjected to a print-out test similarly as in Example 8 except that the toner re-use mechanism as shown in FIG. 4 was removed, the print-out speed was changed to 16 A4-size sheets/min and the print-out test was performed in a continuous mode (i.e., a toner consumption promotion mode without pause of the developing device) while replenishing the toner as required.

Toner (A) was evaluated with respect to the items of the printed-out images and also with respect to matching with the image forming apparatus, according to the manner described hereinafter, whereby Toner (A) exhibited good performances with respect to all the items evaluated.

With respect to the evaluation items shown in Tables 3–6, methods of evaluation and evaluation standards are inclusively described hereinbelow.

Anti-Blocking Property of Toner 10 g of a sample toner is placed in a 50 ml-plastic cup and left standing for 1 week in a hot air drier set at 50° C. Then, the flowability of the toner is evaluated by observation with eyes while gently turning the plastic cup according to the following standard.

| | |
|---|---|
| A: | Flowability has not been impaired. |
| B: | Flowability has been impaired but is gradually restored as the turning of the cup is continued. |
| C: | Agglomerate is observed but can be disintegrated by prickling with a needle. |
| D: | Severe agglomeration or caking has occurred to such an extent that it cannot be disintegrated by prickling with a needle. |

Print-Out Image Evaluation

<1> I.D. (Image Density)

Evaluated based on a relative image density after printing out on a prescribed number of ordinary copying paper (75 g/m$^2$) by a Macbeth reflective densitometer relative to a print-out image of a white ground portion having an original density of 0.00 according to the following standard:

| | |
|---|---|
| A: | ≧1.40 |
| B: | ≧1.35 and <1.40 |
| C: | ≧1.00 and <1.35 |
| D: | <1.00 |

<2> Image Density Uniformity

A solid black image is printed continuously on two sheets, and a density difference occurring on the second sheet is measured by using a Macbeth reflective densitometer.

| | |
|---|---|
| A: | <0.05 |
| B: | ≧0.05 and <0.10 |
| C: | ≧0.10 and <0.30 |
| D: | ≧0.30 |

<3> Dot Reproducibility

Figure 7:
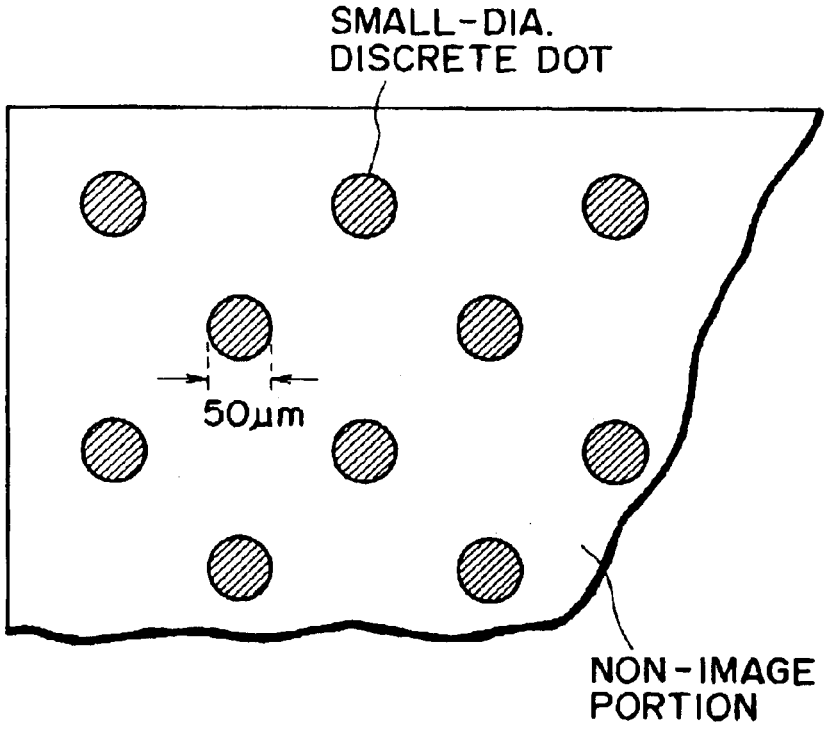
FIG. 7 is an illustration of a discrete dot pattern for evaluating a developing performance of a toner.

A pattern of small-diameter discrete dots (of 50 $\mu$m in diameter) as shown in FIG. 7, the reproduction of which is rather difficult due to the liability of a closed electric field by a latent image electric field, is printed, and the reproducibility of the dots is evaluated by counting the number of lacked dots:

| | |
|---|---|
| A: | ≦2 lacked dots/100 dots |
| B: | 3–5 lacked dots/100 dots |
| C: | 6–10 lacked dots/100 dots |
| D: | ≧11 lacked dots/100 dots |

<4> Fog

Image fog was evaluated based on a fog density (%) based on a difference in whiteness (reflectance) between a white ground portion of a printed-out image and transfer paper per se before printing based on values measured by using a reflective densitometer ("REFLECTOMETER" available from Tokyo Denshoku K.K.)

| | |
|---|---|
| A: | <1.5% |
| B: | ≧1.5% and <2.5% |
| C: | ≧2.5% and <4.0% |
| D: | ≧4% |

<5> Scatter (Toner Scattering Around Image)

Figure 8A:
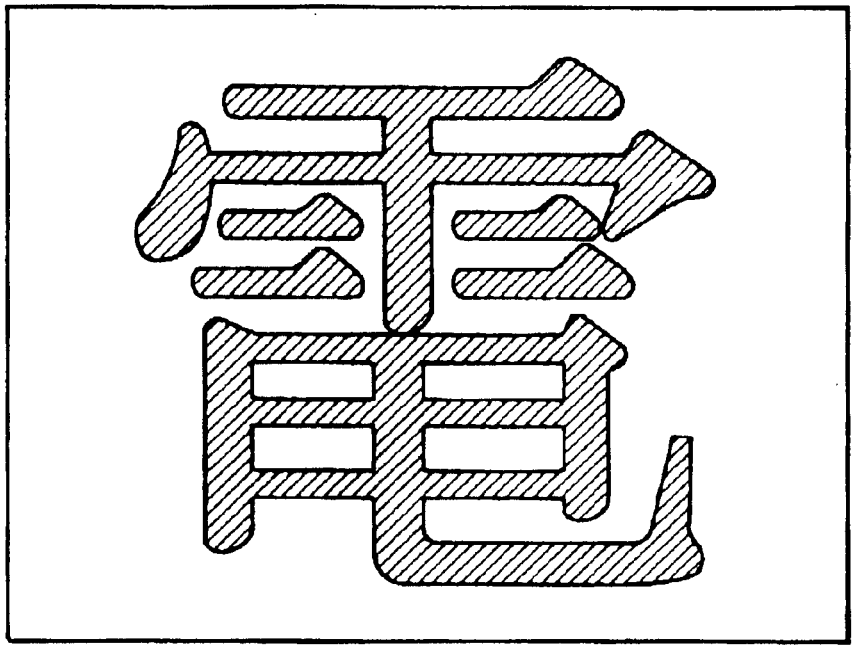
FIGS. 8A and 8B illustrate toner images of a Chinese character without and with toner scattering, respectively.
Figure 8B:
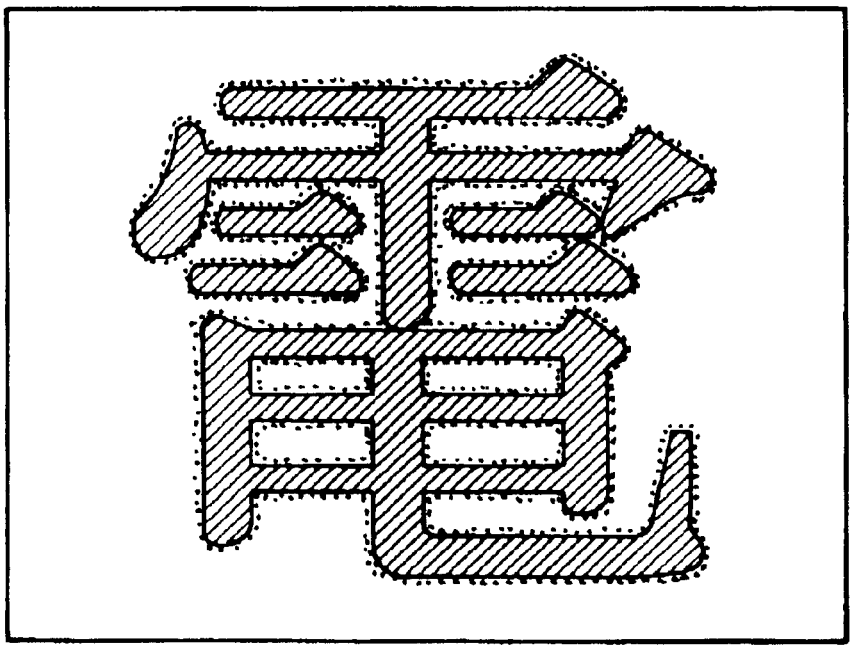

A Chinese character image pattern (actual font size=6 point) shown in FIG. 8A is printed on plain paper (75 g/m$^2$) and thick papers (105 g/m$^2$ and 135 g/m$^2$), and the state of toner scattering (as schematically illustrated in FIG. 8B) around the character image is observed through a magnifying glass at a magnification of 30.

| | |
|---|---|
| A: | Substantially no scattering. |
| B: | Slight scattering observed. |
| C: | Some scattering observed. |
| D: | Conspicuous scattering observed. |

<6> Hollow Image (Dropout)

Figure 9A:
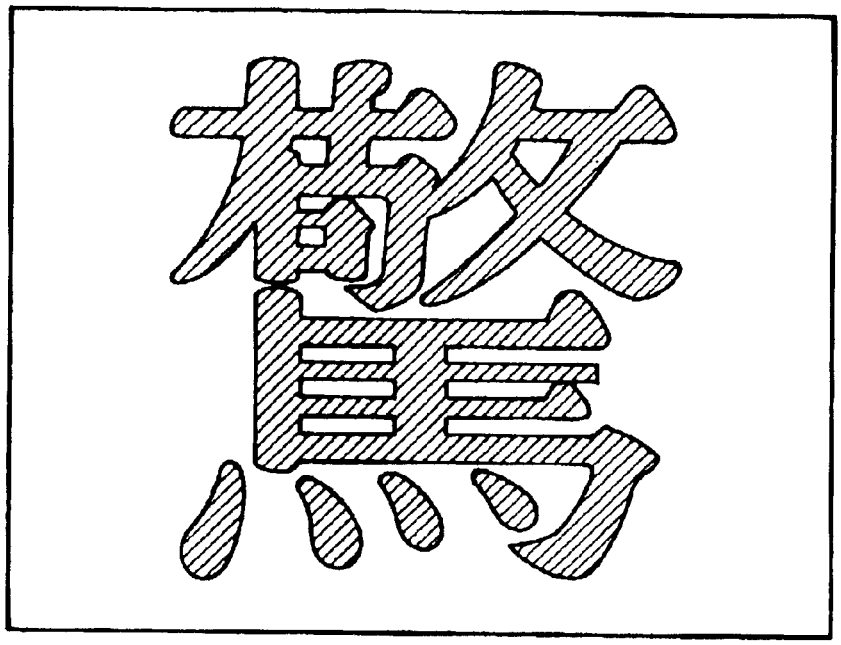
FIGS. 9A and 9B illustrate toner images of another Chinese character without and with hollow image portions.
Figure 9B:
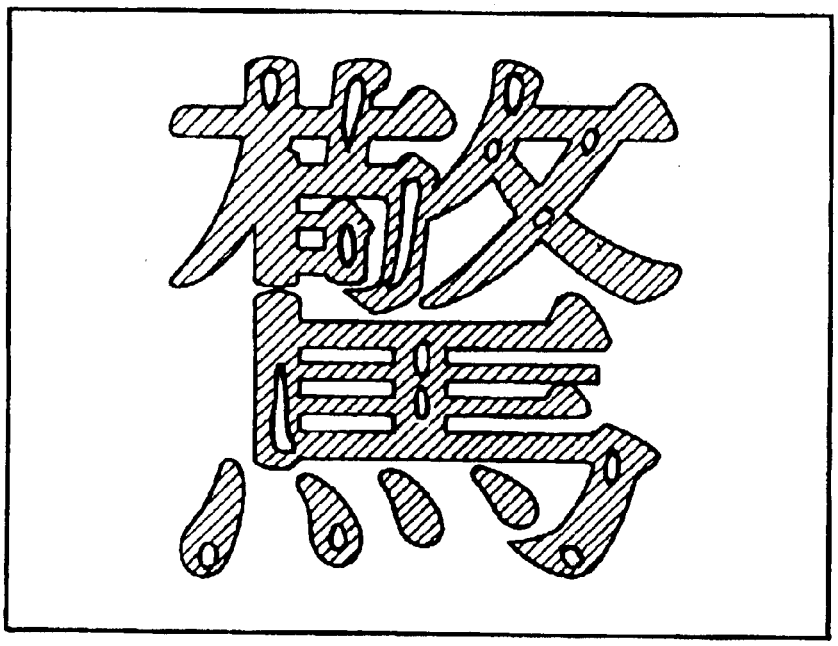

A Chinese character pattern (actual font size=10 point) as shown in FIG. 9A is printed on thick papers (128 g/m$^2$ and 135 g/m$^2$), and the state of occurrence of hollow image dropout (as illustrated in FIG. 9B) is observed through a magnifying glass at a magnification of 30.

| | |
|---|---|
| A: | Substantially no dropout. |
| B: | Slight dropout observed. |
| C: | Some dropout observed. |
| D: | Conspicuous dropout observed. |

Evaluation of Matching with the Image Forming Apparatus

<1> Matching With a Developing Sleeve

After the print-out test, the state of occurrence of residual toner adhesion onto the developing sleeve surface and the influence thereof on the printed-out images are evaluated with eyes.

| | |
|---|---|
| A: | Not observed. |
| B: | Almost not observed. |
| C: | Adhesion observed but little influence on the images. |
| D: | Much adhesion and resulted in image irregularity. |

<2> Matching with a Photosensitive Drum

After the print-out test, the damages on the photosensitive drum surface, the state of occurrence of residual toner adhesion onto the drum surface and the influences thereof on the printed-out images are evaluated with eyes.

| | |
|---|---|
| A: | Not observed. |
| B: | Slight damage observed but no influence on the images. |
| C: | Toner adhesion and damage observed but little influence on the images. |
| D: | Much adhesion and resulted in vertical streak image defects. |

<3> Matching with an Intermediate Transfer Member

After the print-out test, the state of damages and residual toner adhesion on the surface of the intermediate transfer member, and the influence thereof on the printed-out images, are evaluated with eyes.

| | |
|---|---|
| A: | Not observed. |
| B: | Surface residual toner observed but no influence on the images. |
| C: | Toner adhesion and damage observed but little influence on the images. |
| D: | Much adhesion and resulted in image irregularity. |

<4> Matching with a Fixing Device

After the print-out test, the state of damage and residual toner adhesion on the fixing film, and the influence thereof on the printed-out images, are evaluated with eyes.

| | |
|---|---|
| A: | Not observed. |
| B: | Slight toner adhesion observed but no influence on the images. |
| C: | Toner adhesion and damage observed but little influence on the images. |
| D: | Much toner adhesion and resulted in image defects. |

What is claimed is:

1. An image forming method, comprising:

a charging step of charging an image-bearing member, an electrostatic image forming step of forming an electrostatic image on the charged image-bearing member;

a developing step of developing the electrostatic image with a toner carried on a developer-carrying member to form a toner image on the image bearing member, a first transfer step of transferring the toner image on the image-bearing member to an intermediate transfer member, a second transfer step of transferring the toner image on the intermediate transfer member onto a recording material, and a fixing step of heat-fixing the toner image on the recording material; wherein the toner comprises toner particles each containing a binder resin, a colorant and a wax;

the toner has a number-average particle size of 2–6 $\mu$m and a standard deviation in particle size of below 2.6 $\mu$m based on a number-basis distribution of circle-equivalent diameters, an average circularity of 0.970–0.995 and a standard deviation in circularity of below 0.030 based on a circularity frequency distribution, and a residual monomer content of at most 500 ppm; and the toner particles have such a microtexture as to provide a particle cross section as observed through a transmission electron microscope (TEM) exhibiting a matrix of the binder resin and a particle of the wax dispersed in a discrete form in the matrix of the binder resin.

2. The image forming method according to claim 1, wherein the toner has an average circularity of 0.980–0.995 based on a circularity frequency distribution.

3. The image forming method according to claim 1, wherein the toner has a residual monomer content of at most 200 ppm.

4. The image forming method according to claim 1, wherein the toner has a residual monomer content of at most 50 ppm.

5. The image forming method according to claim 1, wherein the wax is contained in 1–30 wt. parts per 100 wt. parts of the binder resin in the toner.

6. The image forming method according to claim 1, wherein the wax is contained in 4–20 wt. parts per 100 wt. parts of the binder resin in the toner.

7. The image forming method according to claim 1, wherein the toner further contains a polycarbonate resin.

8. The image forming method according to claim 7, wherein the polycarbonate resin is contained in 0.1–50 wt. parts per 100 wt. parts of the binder resin.

9. The image forming method according to claim 7, wherein the polycarbonate resin has a peak molecular weight of $10^3$–$5\times10^5$ as measured by gel permeation chromatography (GPC).

10. The image forming method according to claim 1, wherein the toner particles have such a microtexture as to provide 10 arbitrarily selected toner particle cross-sections each having a longer-axis diameter R in a range of $0.9\times D4 \leqq R \leqq 1.1\times D4$ with respect to a weight-average circle-equivalent diameter D4 as measured by a flow particle image analyzer, and the 10 arbitrarily selected toner particle cross-sections provide 10 values each of r and R giving an average $(r/R)_{av.}$ satisfy $0.05 \leqq (r/R)_{av.} \leqq 0.95$, wherein r denotes a maximum longer-axis diameter of wax particle(s) dispersed discretely in a shape of sphere or spindle in the matrix of the binder resin in each toner particle cross-section.

11. The image forming method according to claim 10, wherein the $(r/R)_{av.}$ is in the range of $0.25 \leqq (r/R)_{av.} \leqq 0.90$.

12. The image forming method according to claim 1, wherein the developer-carrying member has a surface roughness Ra of at most 1.5 $\mu$m and is moved at a surface velocity which is 1.05–3 times that of the image-bearing member in a developing region.

13. The image forming method according to claim 1, wherein a magnetic metal blade is disposed opposite to and with a gap from the developer-carrying member.

14. The image forming method according to claim 1, wherein an elastic blade is disposed opposite to and abutted against the developer-carrying member.

15. The image forming method according to claim 1, wherein the developing is performed while applying an alternating electric field between the developer-carrying member and the image-bearing member disposed with a spacing from each other.

16. The image forming method according to claim 1, wherein the image-bearing member is charged by a charging roller supplied with a voltage from an external voltage supply and contacting the image bearing member.

17. The image forming method according to claim 1, performed by an image forming apparatus equipped with a re-use mechanism for recovering a transfer residual toner remaining on the image-bearing member, and re-using the recovered toner in the developing step.

18. An image forming method, comprising:

a charging step of charging an image-bearing member, an electrostatic image forming step of forming an electrostatic image on the charged image-bearing member;

a developing step of developing the electrostatic image with a toner carried on a developer-carrying member to form a toner image on the image bearing member, a transfer step of transferring the toner image on the image-bearing member onto a recording material, and a fixing step of heat-fixing the toner image on the recording material; wherein the toner comprises toner particles each containing a binder resin, a colorant and a wax;

the toner has a number-average particle size of 2–6 $\mu$m and a standard deviation in particle size of below 2.6 $\mu$m based on a number-basis distribution of circle-equivalent diameters, an average circularity of 0.970–0.995 and a standard deviation in circularity of below 0.030 based on a circularity frequency distribution, and a residual monomer content of at most 500 ppm; and the toner particles have such a microtexture as to provide a particle cross section as observed through a transmission electron microscope (TEM) exhibiting a matrix of the binder resin and a particle of the wax dispersed in a discrete form in the matrix of the binder resin.

19. The image forming method according to claim 18, wherein the toner has an average circularity of 0.980–0.995 based on a circularity frequency distribution.

20. The image forming method according to claim 18, wherein the toner has a residual monomer content of at most 200 ppm.

21. The image forming method according to claim 18, wherein the toner has a residual monomer content of at most 50 ppm.

22. The image forming method according to claim 18, wherein the wax is contained in 1–30 wt parts per 100 wt. parts of the binder resin in the toner.

23. The image forming method according to claim 18, wherein the wax is contained in 4–20 wt. parts per 100 wt. parts of the binder resin in the toner.

24. The image forming method according to claim 18, wherein the toner further contains a polycarbonate resin.

25. The image forming method according to claim 24, wherein the polycarbonate resin is contained in 0.1–50 wt. parts per 100 wt. parts of the binder resin.

26. The image forming method according to claim 24, wherein the polycarbonate resin has a peak molecular weight of $10^3$–$5\times10^5$ as measured by gel permeation chromatography (GPC).

27. The image forming method according to claim 18, wherein the toner particles have such a microtexture as to provide 10 arbitrarily selected toner particle cross-sections each having a longer-axis diameter R in a range of $0.9\times D4 \leqq R \leqq 1.1\times D4$ with respect to a weight-average circle-equivalent diameter D4 as measured by a flow particle image analyzer, and the 10 arbitrarily selected toner particle cross-sections provide 10 values each of r and R giving an average $(r/R)_{av.}$ satisfy $0.05 \leqq (r/R)_{av.} \leqq 0.95$, wherein r denotes a maximum longer-axis diameter of wax particle(s) dispersed discretely in a shape of sphere or spindle in the matrix of the binder resin in each toner particle cross-section.

28. The image forming method according to claim 27, wherein the $(r/R)_{av.}$ is in the range of:

$0.25 \leqq (r/R)_{av.} \leqq 0.90$.

29. The image forming method according to claim 18, wherein the developer-carrying member has a surface roughness Ra of at most 1.5 $\mu$m and is moved at a surface velocity which is 1.05–3 times that of the image-bearing member in a developing region.

30. The image forming method according to claim 18, wherein a magnetic metal blade is disposed opposite to and with a gap from the developer-carrying member.

31. The image forming method according to claim 18, wherein an elastic blade is disposed opposite to and abutted against the developer-carrying member.

32. The image forming method according to claim 18, wherein the developing is performed while applying an alternating electric field between the developer-carrying member and the image-bearing member disposed with a spacing from each other.

33. The image forming method according to claim 18, wherein the image-bearing member is charged by a charging roller supplied with a voltage from an external voltage supply and contacting the image bearing member.

34. The image forming method according to claim 18, performed by an image forming apparatus equipped with a re-use mechanism for recovering a transfer residual toner remaining on the image-bearing member, and re-using the recovered toner in the developing step.

* * * * *

UNITED STATES PATENT AND TRADEMARK OFFICE

CERTIFICATE OF CORRECTION

PATENT NO. : 6,806,016 B2
DATED : October 19, 2004
INVENTOR(S) : Manabu Ohno et al.

It is certified that error appears in the above-identified patent and that said Letters Patent is hereby corrected as shown below:

Title page,
Item [75], Inventors, "Manabu Ohno, Shizuoka(JP); Satoshi Yoshida, Tokyo (JP); Satoshi Handa, Tokyo (JP); Akira Hashimoto, Tokyo (JP); Keiji Komoto, Tokyo (JP)" should read -- Manabu Ohno, Numazu-shi (JP); Satoshi Yoshida, Tokyo (JP); Satoshi Handa, Suntoh-gun Hashimoto, Numazu-Shi (JP); Keiji Komoto, Numazu-shi (JP) --.
Item [56], References Cited, OTHER PUBLICATIONS, "Hawl y," should read --Hawly, -- and "9th d." should read -- 9th ed. --.

Column 1,
Line 66, "case" should read -- a case --; and
Line 67, "having" should read -- has --.

Column 2
Line 42, "companied" should read -- accompanied --.

Column 5.
Line 50, "to result" should read -- resulting --; and
Line 55, "provide" should read -- provided --.

Column 6,
Line 26, "mfd" should read -- mfd. --.

Column 12,
Line 47, "soling" should read -- soiling --.

Column 19,
Line 18, "Within an extent" should read -- To the extent --; and
Line 25, "agent," should read -- agents, --.

Column 21,
Line 52, "and" (2nd occurrence) should read -- an --.

Column 22,
Line 24, "is" should read -- are --.

Column 23,
Line 53, ""SURCODER SE-30h"" should read -- "SURFCODER SE-30H" --.

UNITED STATES PATENT AND TRADEMARK OFFICE

CERTIFICATE OF CORRECTION

PATENT NO. : 6,806,016 B2
DATED : October 19, 2004
INVENTOR(S) : Manabu Ohno et al.

It is certified that error appears in the above-identified patent and that said Letters Patent is hereby corrected as shown below:

Column 29,
Line 55, "Parts" should read -- parts --.

Column 34,
Line 2, "obtained" should read -- obtained by --.

Column 37,
Line 38, "paper" should read -- papers --.

Column 38,
Line 66, "damages" should read -- damage --.

Column 39,
Line 13, "damages" should read -- damage --.

Signed and Sealed this

Twelfth Day of July, 2005

JON W. DUDAS
*Director of the United States Patent and Trademark Office*